US005738963A

United States Patent [19]

Niino

[11] Patent Number: 5,738,963

[45] Date of Patent: Apr. 14, 1998

[54] LIGHT-RECEIVING MEMBER FOR ELECTROPHOTOGRAPHY HAVING A PHOTOCONDUCTIVE LAYER COMPOSED OF A FIRST LAYER REGION AND A SECOND LAYER REGION HAVING DIFFERENT ENERGY BANDGAPS AND CHARACTERISTIC ENERGIES

[75] Inventor: Hiroaki Niino, Nara, Japan

[73] Assignee: Canon Kabushiki Kaisha, Tokyo, Japan

[21] Appl. No.: 698,925

[22] Filed: Aug. 16, 1996

[30] Foreign Application Priority Data

Aug. 23, 1995 [JP] Japan ..... 7-214799

[51] Int. Cl.[6] ..... G03G 5/153

[52] U.S. Cl. ..... 430/57; 430/65

[58] Field of Search ..... 430/57, 58, 63, 430/65, 66, 128, 132

[56] References Cited

U.S. PATENT DOCUMENTS

| | | | |
|---|---|---|---|
| 4,265,991 | 5/1981 | Hirai et al. | 430/64 |
| 4,409,311 | 10/1983 | Kawamura et al. | 430/95 |
| 4,607,936 | 8/1986 | Miyakawa et al. | 355/3 DR |
| 4,650,736 | 3/1987 | Saitoh et al. | 430/57 |
| 4,659,639 | 4/1987 | Mizuno et al. | 430/65 |
| 4,705,733 | 11/1987 | Saitoh et al. | 430/57 |
| 4,735,883 | 4/1988 | Honda et al. | 430/69 |
| 4,782,376 | 11/1988 | Catalano | 357/30 |
| 4,788,120 | 11/1988 | Shirai et al. | 430/66 |
| 4,797,327 | 1/1989 | Honda et al. | 428/600 |
| 4,882,251 | 11/1989 | Aoike et al. | 430/57 |
| 5,053,844 | 10/1991 | Murakami et al. | 357/30 |
| 5,382,487 | 1/1995 | Fukuda et al. | 430/57 |
| 5,514,506 | 5/1996 | Takai et al. | 430/57 |
| 5,576,060 | 11/1996 | Hirai et al. | 430/128 |

FOREIGN PATENT DOCUMENTS

| | | |
|---|---|---|
| 0039223 | 11/1981 | European Pat. Off. . |
| 0300807 | 11/1989 | European Pat. Off. . |
| 0343851 | 11/1989 | European Pat. Off. . |
| 0454456 | 10/1991 | European Pat. Off. . |
| 3616608 | 11/1986 | Germany . |
| 57-115556 | 7/1982 | Japan . |
| 57-158650 | 9/1982 | Japan . |
| 58-21257 | 2/1983 | Japan . |
| 58-121042 | 7/1983 | Japan . |
| 59-143379 | 8/1984 | Japan . |
| 60-67951 | 4/1985 | Japan . |
| 60-95551 | 5/1985 | Japan . |
| 60-168156 | 8/1985 | Japan . |
| 60-178457 | 9/1985 | Japan . |
| 60-225854 | 11/1985 | Japan . |
| 61-201481 | 9/1986 | Japan . |
| 61-231561 | 10/1986 | Japan . |
| 62-83470 | 4/1987 | Japan . |

*Primary Examiner*—John Goodrow

*Attorney, Agent, or Firm*—Fitzpatrick, Cella, Harper & Scinto

[57] ABSTRACT

To improve photoconductive and photoelectric-conversionary properties, e.g., to improve charging performance and at the same time make its temperature dependence lower, and to prevent exposure memory to achieve good image quality, a light-receiving member comprises a support and a photoconductive layer formed of a non-single-crystal (e.g., amorphous) material mainly composed of silicon atoms and containing at least one kind of hydrogen atoms and halogen atoms, wherein the photoconductive layer has a first layer region and a second layer region which have values different from each other in specific ranges in respect of optical bandgap (Eg) and characteristic energy (Eu) obtained from the linear relationship portion or exponential tail of a function represented by Expression (I):

$$\ln \alpha = (1/Eu) \cdot h\nu + \alpha_1 \quad (I)$$

where photon energy hν is set as an independent variable, and absorptivity coefficient α of light absorption spectrum as a dependent variable.

24 Claims, 8 Drawing Sheets

LIGHT-RECEIVING MEMBER FOR ELECTROPHOTOGRAPHY HAVING A PHOTOCONDUCTIVE LAYER COMPOSED OF A FIRST LAYER REGION AND A SECOND LAYER REGION HAVING DIFFERENT ENERGY BANDGAPS AND CHARACTERISTIC ENERGIES

BACKGROUND OF THE INVENTION

1. Field of the Invention

This invention relates to a light-receiving member that receives light (which herein refers to light in a broad sense and includes electromagnetic waves having wavelengths of visible light and those of other than visible light) to effect photoelectric conversion, and more particularly to a light-receiving member preferably used in electrophotographic apparatus.

2. Related Background Art

In the field of image formation, photoconductive materials that form light-receiving layers of light-receiving members are required to have properties, for example, as follows: They are highly sensitive, have a high SN ratio [light current (Ip)/dark current (Id)], have absorption spectra suited to spectral characteristics of electromagnetic waves to be radiated, have a high response to light, have the desired dark resistance and are safe for human use. In particular, in the case where light-receiving members set in an electrophotographic apparatus are used as business machines in offices, the safety in their use is important.

Photoconductive materials having good properties in these respects include hydrogenated amorphous silicon. For example, U.S. Pat. No. 4,265,991 discloses its application in electrophotographic light-receiving members.

In the production of such light-receiving members, it is common to form photoconductive layers comprised of amorphous silicon, by film forming processes such as vacuum deposition, sputtering, ion plating, heat-assisted CVD, light-assisted CVD and plasma-assisted CVD, by which layers are formed on conductive supports while heating the supports at 50° C. to 400° C. In particular, their production by the plasma-assisted CVD is preferable and has been put into practical use. This plasma-assisted CVD is a process in which material gases are decomposed by high-frequency or microwave glow discharging to form amorphous silicon deposited films on the conductive support.

U.S. Pat. No. 5,382,487 discloses an electrophotographic light-receiving member having a photoconductive layer comprising amorphous silicon containing halogen atoms formed on an electroconductive support. This publication reports that incorporation of 1 to 40 atomic % of halogen atoms into amorphous silicon enables achievement of a high thermal resistance, and also electrical and optical properties preferable for a photoconductive layer of an electrophotographic light-receiving member.

Japanese Patent Application Laid-open No. 57-115556 discloses a technique in which a surface barrier layer formed of a non-photoconductive amorphous material containing silicon atoms and carbon atoms is provided on a photoconductive layer formed of an amorphous material mainly composed of silicon atoms, in order to achieve improvements in electrical, optical and photoconductive properties such as dark resistance, photosensitivity and response to light and service environmental properties such as moisture resistance and also in stability with time.

Japanese Patent Application Laid-open No. 60-67951 discloses a technique concerning a photosensitive member superposingly provided with a light-transmitting insulating overcoat layer containing amorphous silicon, carbon, oxygen and fluorine.

U.S. Pat. No. 4,788,120 discloses a technique in which an amorphous material containing silicon atoms, carbon atoms and 41 to 70 atomic % of hydrogen atoms as constituents is used to form a surface layer.

Japanese Patent Application Laid-open No. 57-158650 discloses that a highly sensitive and highly resistant, electrophotographic photosensitive member can be obtained by using in a photoconductive layer a hydrogenated amorphous silicon containing 10 to 40 atomic % of hydrogen and having absorption peaks at 2,100 $cm^{-1}$ and 2,000 $cm^{-1}$ in an infrared absorption spectrum which peaks are in a ratio of 0.2 to 1.7 as the coefficient of absorption.

Japanese Patent Application Laid-open No. 62-83470 discloses a technique in which characteristic energy of an exponential tail of light absorption spectra is controlled to be not more than 0.09 eV in a photoconductive layer of an electrophotographic photosensitive member to thereby obtain high-quality images free of after-image development.

Japanese Patent Application Laid-open No. 58-21257 discloses a technique in which support temperature is changed in the course of the formation of a photoconductive layer and forbidden band width is changed in the photoconductive layer to thereby obtain a photosensitive member having a high resistance and a broad photosensitive region.

Japanese Patent Application Laid-open No. 58-121042 discloses a technique in which energy gap state density is changed in the direction of layer thickness of a photoconductive layer and energy gap state density of a surface layer is controlled to be $10^{17}$ to $10^{19}$ $cm^{-3}$ to thereby prevent surface potential from lowering because of humidity.

Japanese Patent Application Laid-open No. 59-143379 and No. 61-201481 disclose a technique in which hydrogeneted amorphous silicon layers having different hydrogen content are superposingly formed to obtain a photosensitive member having a high dark resistance and a high sensitivity.

Meanwhile, Japanese Patent Application Laid-open No. 60-95551 discloses a technique in which, directed at an improvement in image quality of an amorphous silicon photosensitive member, image forming steps of charging, exposure, development and transfer are carried out while maintaining temperature at 30° to 40° C. in the vicinity of the surface of the photosensitive member to thereby prevent the surface of the photosensitive member from undergoing a decrease in surface resistance which is due to water absorption on that surface and also prevent smeared images from occurring concurrently therewith.

These techniques have achieved improvements in photoconductive properties such as dark resistance, photosensitivity and response to light and service environmental properties of electrophotographic light-receiving members, and also have concurrently brought about an improvement in image quality.

The electrophotographic light-receiving members having a photoconductive layer comprised of an amorphous silicon material (comprising silicon atoms as a matrix) have individually achieved improvements in performance in respect of photoconductive properties, service environmental properties and running performance (durability). However, there is room for further improvements when overall performances are taken into account. In particular, it has been sought to prevent variations of electrophotographic performances (e.g., charging performance) due to changes in surrounding temperature (i.e., improve service environmental properties), to decrease the occurrence of exposure memory (light memory) such as blank memory and ghost, and also to improve uniformity of image density (i.e., prevent what is called coarse images).

In electrophotographic apparatus, in order to prevent smeared images caused by amorphous silicon photosensitive members, a drum heater is often used to keep the surface temperature of the photosensitive member at about 40° C., as disclosed in Japanese Patent Application Laid-open No. 60-95551. In conventional photosensitive members, however, the dependence of charge performance on temperature, which is ascribable to formation of pre-exposure carriers or heat-energized carriers is so great that photosensitive members could not avoid being used in the state where they have a lower charging performance than that originally possessed by the photosensitive members. For example, the charging performance may drop by nearly 100 V in the state where the photosensitive members are heated to about 40° C., compared with the case when used at room temperature.

In the period (e.g., at night) when electrophotographic apparatus are not used, the drum heater is kept electrified in some cases so as to prevent the smeared images that are caused when ozone products formed by corona discharging of a charging assembly are adsorbed on the surface of a photosensitive member. Nowadays, however, it has become popular not to electrify the apparatus when not in use (e.g., at night), for the purpose of saving electric power. When copies are continuously made without electrifying the drum heater, the surrounding temperature of the photosensitive member gradually rises to decrease charging performance with increasing temperature, causing, in some cases, the problem of a change in image density during the copying.

When the same original is continuously and repeatedly copied, a density difference on copied images (called "blank memory") may also occur because of the influence of blank exposure (which is exposure carried out for saving toner, and is irradiation made on the photosensitive member at the paper feed intervals during the continuous copying), or an after-image due to imagewise exposure in the previous copying step (which is called "ghost") may be formed on the image in the subsequent copying.

Then, as a result of improvements made on optical exposure assemblies, developing assemblies, transfer assemblies in electrophotographic apparatus in order to improve image quality, the resolution of the electrophotographic apparatus has been improved, and this may make conspicuous any minute uneven density on images, what is called coarse images.

SUMMARY OF THE INVENTION

Accordingly, an object of the present invention is to provide a light-receiving member that can promise a good image quality, achieved by improving charging performance and at the same time decreasing temperature dependence, and by controlling exposure memory such as blank memory and ghost and improving uniformity of image density (free of coarse images).

The present invention provides a light-receiving member comprising a support and a photoconductive layer formed of a non-single-crystal material mainly composed of silicon atoms and containing at least one kind of hydrogen atoms and halogen atoms; wherein the photoconductive layer has a first layer region in which optical bandgap (Eg) is from 1.70 eV to 1.82 eV and characteristic energy (Eu) obtained from the linear relationship portion (exponential tail) of a function represented by Expression (I):

$$\ln \alpha = (1/Eu) \cdot h\nu + \alpha_1 \quad \text{(I)}$$

where photon energy (hν) is set as an independent variable, and absorptivity coefficient (α) of light absorption spectrum as a dependent variable is from 50 meV to 65 meV, and a second layer region in which the Eg is from 1.78 eV to 1.85 eV and the Eu is from 50 meV to 60 meV, provided that the Eg of the first layer region is smaller than the Eg of the second layer region and the Eu of the first layer region is larger than the Eu of the second layer region; and the first and second layer regions are superposingly formed.

The present invention also provides, in the light-receiving member described above, a light-receiving member wherein the hydrogen atom and/or halogen atom content (Ch) is from 10 atomic % to 30 atomic % in the first layer region and from 20 atomic % to 40 atomic % in the second layer region, provided that the Ch in the first layer region is smaller than the Ch of the second layer region.

The present invention still also provides, in the light-receiving member described above, a light-receiving member wherein the ratio of the thickness of the whole photoconductive layer to the thickness of one second layer region is from 1:0.003 to 1:0.15.

The present invention further provides, in the light-receiving member described above, a light-receiving member wherein the photoconductive layer has one first layer region and one second layer region each, and the second layer region is superposingly formed on the first layer region.

The present invention still further provides, in the light-receiving member described above, a light-receiving member wherein the photoconductive layer has one first layer region and one second layer region each, and the first layer region is superposingly formed on the second layer region.

The present invention still further provides, in the light-receiving member described above, a light-receiving member wherein the photoconductive layer has one first layer region and two second layer regions, and the first layer region is superposingly formed on one of the second layer regions and the other second layer region is superposingly formed on the first layer region.

The present invention still further provides, in the light-receiving member described above, a light-receiving member wherein the photoconductive layer contains at least one kind of atoms belonging to Group 13 (Group 3B, hereinafter "Group IIIb") of the periodic table, capable of imparting p-type conductivity, and atoms belonging to Group 15 (Group 5B, hereinafter "Group Vb") of the periodic table, capable of imparting n-type conductivity.

The present invention still further provides, in the light-receiving member described above, a light-receiving member wherein the photoconductive layer contains at least one kind of atoms selected from the group consisting of carbon, oxygen and nitrogen.

The present invention still further provides, in the light-receiving member described above, a light-receiving member wherein a surface layer mainly composed of silicon atoms and containing at least one kind of atoms selected from the group consisting of carbon, oxygen and nitrogen is superposingly formed on the photoconductive layer.

The present invention still further provides, in the light-receiving member described above, a light-receiving member wherein the surface layer is formed in a thickness of from 0.01 μm to 3 μm.

The present invention still further provides, in the light-receiving member described above, a light-receiving member wherein a charge injection blocking layer is provided which is formed of a non-single-crystal material, mainly composed of silicon atoms and containing at least one kind of atoms selected from the group consisting of carbon, oxygen and nitrogen and at least one kind of atoms belonging to Group IIIb of the periodic table, capable of imparting p-type conductivity, and atoms belonging to Group Vb of the periodic table, capable of imparting n-type conductivity, and the photoconductive layer is superposingly formed on the charge injection blocking layer.

The present invention still further provides, in the light-receiving member described above, a light-receiving member wherein the charge injection blocking layer is formed in a thickness of from 0.1 μm to 5 μm.

The present invention still further provides, in the light-receiving member described above, a light-receiving member wherein the photoconductive layer is formed in a thickness of from 20 μm to 50 μm.

DESCRIPTION OF THE PREFERRED EMBODIMENTS

Figure 1:
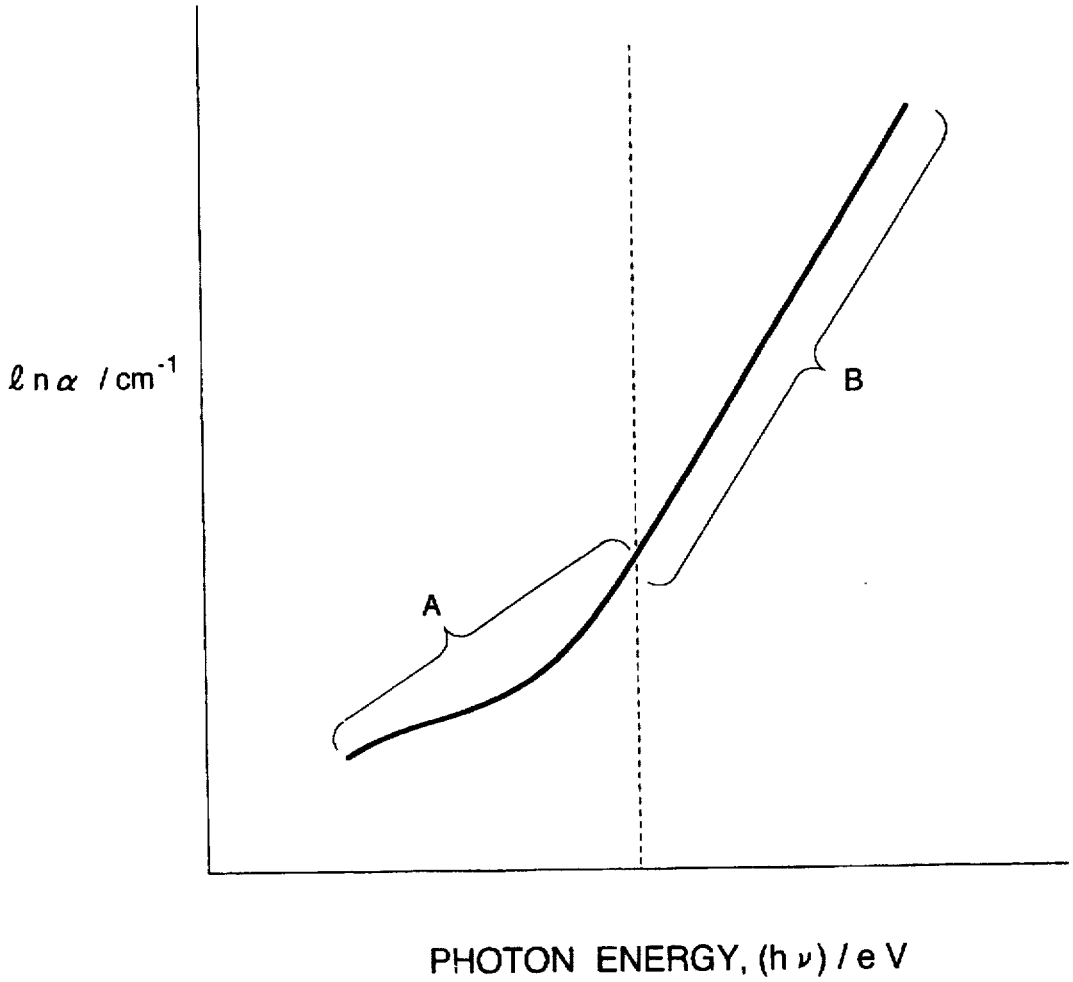
FIG. 1 is a graph showing an example of sub-bandgap light absorption spectrum of the photoconductive layer in the present invention.

The present invention will be described below in detail.

In the present description, "amorphous material mainly composed of silicon atoms", which typifies non-single-crystal silicon, is often referred to as "amorphous silicon material", and "amorphous material mainly composed of silicon atoms and containing at least one kind of hydrogen atoms and halogen atoms" is often referred to as "a-Si:X". The term "amorphous silicon containing hydrogen atoms" is also often referred to as "hydrogenated amorphous silicon", and "amorphous silicon containing halogen atoms" as "halide amorphous silicon", these are embraced in the representation "a-Si:X".

The light-receiving member of the present invention comprises a photoconductive layer formed of amorphous (non-single-crystal) material mainly composed of silicon atoms and containing at least one kind of hydrogen atoms and halogen atoms. The photoconductive layer has a first layer region and a second layer region each having specific optical bandgap (Eg) and characteristic energy (Eu).

The photoconductive layer must contain hydrogen atoms or halogen atoms. It may contain both hydrogen atoms and halogen atoms. This enables compensation of dangling bonds of silicon atoms and achievement of improvement in layer quality, in particular, improvement in photoconductivity and charge retention performance.

In the light-receiving member, the hydrogen atom and/or halogen atom content (Ch) may preferably be in a range from 10 atomic % to 30 atomic % in the first layer region and from 20 atomic % to 40 atomic % in the second layer region, provided that the Ch in the first layer region is smaller than the Ch of the second layer region. More preferably, the Ch may be in a range of not less than 15 atomic % to less than 25 atomic % in the first layer region, and in a range of not less than 25 atomic % to not more than 35 atomic % in the second layer region.

Herein, the term "hydrogen atom and/or halogen atom content (Ch)" refers to "hydrogen atom content" in an instance where only hydrogen atoms are incorporated when the photoconductive layer is formed, or "halogen atom content" in an instance where only halogen atoms are incorporated, or "the total of hydrogen atom content and halogen atom content" in an instance where both hydrogen atoms and halogen atoms are incorporated. The unit "atomic %" is a proportion to the total content of hydrogen atoms and/or halogen atoms and silicon atoms.

The photoconductive layer in the present invention must have an optical bandgap (Eg) of from 1.70 eV to 1.82 eV in the first layer region and 1.78 eV to 1.85 eV in the second layer region, provided that the Eg of the first layer region is smaller than the Eg of the second layer region. More preferably, the photoconductive layer may have an Eg of not less than 1.75 eV to less than 1.80 eV in the first layer region and not less than 1.80 eV to not more than 1.83 eV in the second layer region.

The photoconductive layer in the present invention must also have a characteristic energy (Eu), which is obtained from the linear relationship portion (exponential tail) of a function represented by Expression (I):

$$\ln \alpha = (1/Eu) \cdot h\nu + \alpha_1 \quad \text{(I)}$$

where photon energy (hν) is set as an independent variable, and absorptivity coefficient (α) of light absorption spectrum as a dependent variable, of from 50 meV to 65 meV in the first layer region and from 50 meV to 60 meV in the second layer region, provided that the Eu of the first layer region is larger than the Eu of the second layer region; preferably more than 55 meV to not more than 65 meV in the first layer region and not less than 50 meV to not more than 55 meV in the second layer region.

FIG. 1 shows an example of sub-bandgap light absorption spectrum of the photoconductive layer in the present invention. The photon energy (hν) is plotted as abscissa, and a logarithm (ins) of the absorptivity coefficient (α) of light absorption spectrum is plotted as ordinate. This spectrum can be roughly separated into two portions. One of them is portion B where the absorptivity coefficient (α) changes exponentially with respect to the photon energy (hν) , i.e., the lna changes linearly with respect to the hν (the portion called "exponential tail" or "Urback tail"), and the other is portion A where the lnα shows milder dependence on the hν.

The portion B where the lnα changes linearly corresponds to light absorption caused by optical transition from the tail level on the side of valency band to the conduction band, and the exponential dependence of the absorptivity coefficient (α) on the photon energy (hν) is represented by the following Expression (II).

$$\alpha=\alpha_0 \exp (h\nu)/Eu \quad \text{(II)}$$

where $\alpha_0$ is a constant specific to the photoconductive layer. Taking a logarithm of both sides of Expression (II) gives the above Expression (I).

$$\ln \alpha=(1/Eu)\cdot h\nu+\alpha_1 \quad \text{(I)}$$

where $\alpha_1$ is $\ln\alpha_0$.

In Expression (I), the reciprocal (1/Eu) of the characteristic energy (Eu) indicates the slope of the portion B in FIG. 1. The Eu corresponds to the characteristic energy of exponential energy distribution of the tail level on the side of valency band, and hence a smaller Eu indicates less tail level on the side of valency band.

The sub-bandgap light absorption spectrum is commonly measured by deep-level spectroscopy, isothermal volume-excess spectroscopy, photothermal polarization spectroscopy, photoacoustic spectroscopy, or the constant photocurrent method. In particular, the constant photocurrent method (hereinafter "CPM") is useful.

In the present invention, the thickness of the photoconductive layer is appropriately determined taking account of electrophotographic performances economical advantages and so forth. Its thickness may preferably be from 20 μm to 50 μm, and more preferably from 23 μm to 45 μm, and most preferably from 25 μm to 40 μm. If the thickness is smaller than 20 μm, electrophotographic performances such as charging performance and sensitivity may become insufficient in practical use. It it is larger than 50 μm, it may take longer time to form the photoconductive layer, resulting in an increase in production cost.

The second layer region of the photoconductive layer may preferably have a thickness such that the ratio of the thickness of the whole photoconductive layer (the thickness of the first layer region plus that of the second layer region) to the thickness of one second layer region is 1:0.003 to 1:0.15. If the ratio of the thickness of the second layer region is smaller than 0.003, charge injection blocking performance may become insufficient. Especially when the second layer region is positioned on the surface layer side, long-wavelength components of pre-exposure and imagewise exposure can not be well absorbed, so that the temperature dependence of charging performance and exposure memory can not be well effectively decreased in some cases. If on the other hand it is larger than 0.15, in order to obtain well satisfactory film quality for the second layer region, it must be formed at a deposition rate made a little lower than the first layer region under existing circumstances, and hence it may take longer time to form the photoconductive layer, resulting in an increase in production cost.

Figure 2A:
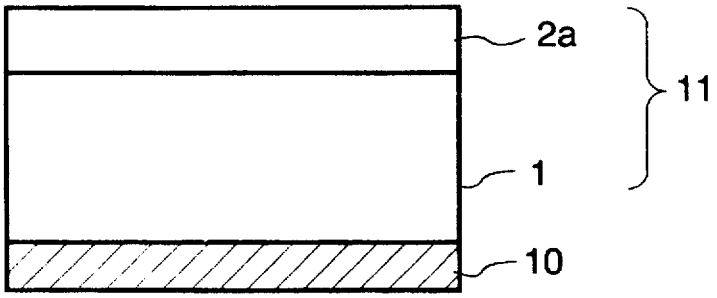
FIGS. 2A to 2C are diagrammatic cross sections showing examples of layer configuration of the photoconductive layer in the light-receiving member according to the present invention.
Figure 2B:
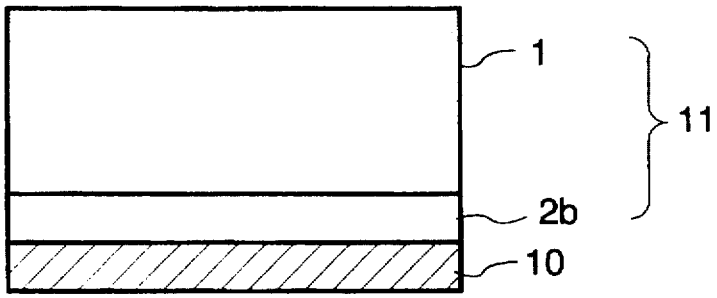
Figure 2C:
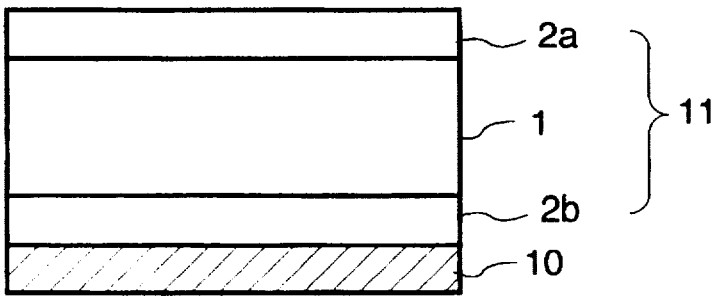

FIGS. 2A to 2C are illustrations (diagrammatic cross sections) of examples of the layer configuration of the photoconductive layer in the present invention. A photoconductive layer 11 in FIG. 2A has one first layer region and one second layer region each, and has the layer configuration that a second layer region **2*a* is superposingly formed on a first layer region 1. A photoconductive layer 11 in FIG. 2B has one first layer region and one second layer region each, and has the layer configuration that a first layer region 1 is superposingly formed on a second layer region 2*b*. A photoconductive layer 11 in FIG. 2C has one first layer region and two second layer regions, and has the layer configuration that a first layer region 1 is superposingly formed on a second layer region 2*b* and a second layer region 2*a* is superposingly formed on the first layer region 1. Reference numeral 10** denotes a support.

Employment of the above layer configuration enables decrease in temperature dependence of charging performance and exposure memory to make it possible to achieve the object of the present invention. Employment of the layer configuration shown in FIG. 2B enables, in addition to the above effect, improvement also in respect of coarse images (density distribution examined on solid images as image characteristics). The photoconductive layer shown in FIG. 2C has both the layer configuration in FIG. 2A and the layer configuration in FIG. 2B, and hence similarly, in addition to the above effect, an improvement can also be made in respect of coarse images.

The photoconductive layer in the present invention is formed by thin-film vacuum deposition. Stated specifically, it can be formed by various thin-film deposition processes as exemplified by glow discharging including AC discharge CVD such as low-frequency CVD, high-frequency CVD or microwave CVD, and DC discharge CVD; and sputtering, vacuum metallizing, ion plating, light CVD and heat CVD. When these thin-film deposition processes are employed, suitable ones are selected according to the conditions for manufacture, the extent of a load on capital investment in equipment, the scale of manufacture and the properties and performances desired on light-receiving members produced. Glow discharging, in particular, high-frequency glow discharging employing RF band or VHF band power source frequency is preferred in view of its relative easiness to control conditions for the manufacture.

When the photoconductive layer is formed by glow discharging, basically a material gas (starting gas) capable of feeding silicon atoms (Si), and a material gas capable of feeding hydrogen atoms and/or a material gas capable of feeding halogen atoms may be introduced, in the desired gaseous state, into a reactor whose inside can be evacuated, and glow discharge may be caused to take place in the reactor so that the photoconductive layer is formed on a support previously set at a given position.

The material capable of feeding Si may include gaseous or gasifiable silanes, e.g., silicon hydrides such as $SiH_4$, $Si_2H_6$, $Si_3H_8$ and $Si_4H_{10}$, which can be effectively used. In view of readiness in handling for layer formation and Si-feeding efficiency, $SiH_4$ and $Si_2H_6$ are preferred.

To incorporate the hydrogen atoms into the photoconductive layer, a desired amount of $H_2$, a mixed gas of $H_2$ and He or a gas of a silicon compound containing hydrogen atoms is mixed in the above material gas. This makes it more easy to control the proportion of incorporating hydrogen atoms in the photoconductive layer.

The material capable of feeding halogen atoms may preferably include gaseous or gasifiable halogen compounds as exemplified by halogen gases, halides, halogen-containing interhalogen compounds and silane derivatives substituted with a halogen. The material may also include gaseous or gasifiable, halogen-containing silicon hydride compounds, which can be also effective. The interhalogen compounds may specifically include fluorine gas ($F_2$), BrF, ClF, $ClF_3$, $BrF_3$, $BrF_5$, $IF_3$ and $IF_7$. Silicon compounds containing halogen atoms, what is called silane derivatives substituted with halogen atoms, may include silicon fluorides such as $SiF_4$ and $Si_2F_6$.

The above material gases may be used alone or in the form of a mixture of two or more species.

In order to control the quantity of the hydrogen atoms and/or halogen atoms incorporated in the photoconductive layer, for example, the temperature of the support, the quantity of materials introduced into the reactor which are used to feed the hydrogen atoms and/or halogen atoms, the discharge power and so forth may be controlled. The starting materials for incorporating the above atoms may be optionally diluted with $H_2$ or He or a mixed gas of $H_2$ and He (dilute gas) when used.

The photoconductive layer in the present invention may preferably be incorporated with atoms capable of controlling its conductivity as occasion calls.

The atoms capable of controlling the conductivity must be contained in and throughout the photoconductive layer and also in a uniform density distribution, but may have non-uniform density distribution at some part in the layer thickness direction. However, even when having non-uniform density distribution at some part, in order to make the effect of their incorporation uniformly effective, the above atoms must be contained all over and also in a uniform density distribution in the in-plane direction parallel to the surface of the support.

The atoms capable of controlling the conductivity may include what is called impurities, used in the field of semiconductors, and it is possible to use atoms belonging to Group 13 (Group 3B) of the periodic table (hereinafter "Group IIIb atoms"), capable of imparting p-type conductivity, or atoms belonging to Group 15 (Group 5B) of the periodic table (hereinafter "Group Vb atoms"), capable of imparting n-type conductivity. Of these, at least one kind of atoms is used. That is, one kind of atoms may be used alone, or two or more kinds of atoms may be used in the form of a mixture.

The Group IIIb atoms may specifically include boron (B), aluminum (Al), gallium (Ga), indium (In) and thallium (Tl). In particular, B, Al and Ga are preferred. The Group Vb atoms may include (hosphorus (P), arsenic (As), antimony (Sb) and bismuth (Bi). In particular, P and As are preferred.

The atoms capable of controlling the conductivity may preferably be contained in the photoconductive layer in an amount of from $1\times10^{-2}$ atomic ppm to $1\times10^{2}$ atomic ppm, more preferably from $5\times10^{-2}$ atomic ppm to 50 atomic ppm, and still more preferably from $1\times10^{-1}$ atomic ppm to 1×10 atomic ppm. It is also preferable to make their content in the second layer region larger than the content in the first layer region.

In order to structurally incorporate the atoms capable of controlling the conductivity, a starting material for incorporating the atoms capable of controlling the conductivity may be fed, when the layer is formed, into the reactor in a gaseous state together with other gases (described above used to form the photoconductive layer.

Those which can be used as the starting material for incorporating the atoms capable of controlling the conductivity should be selected from those which are gaseous at normal temperature and normal pressure or at least those which can be readily gasified under conditions for the layer formation. Such a starting material for incorporating the Group IIIb atoms may include, as a material for incorporating boron atoms, boron hydrides such as $B_2H_6$, $B_4H_{10}$, $B_5H_9$, $B_5H_{11}$, $B_6H_{10}$, $B_6H_{12}$ and $B_6H_{14}$, and boron halides such as $BF_3$, $BCl_3$ and $BBr_3$. Besides, the material may also include $AlCl_3$, $GaCl_3$, $Ga(CH_3)_3$, $InCl_3$ and $TlCl_3$. The starting material for incorporating the Group Vb atoms may include, as a material for incorporating phosphorus atoms, phosphorus hydrides such as $PH_3$ and $P_2H_4$ and phosphorus halides such as $PH_4I$, $PF_3$, $PF_5$, $PCl_3$, $PCl_5$, $PBr_3$, $PBr_5$, and $PI_3$. Besides, the material that can be effectively used may also include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$.

These starting materials for incorporating the atoms capable of controlling the conductivity may be optionally diluted with $H_2$ or He, or a mixed gas of $H_2$ and He (dilute gas) when used.

In the present invention, it is also effective to incorporate in the photoconductive layer at least one kind of carbon atoms, oxygen atoms and nitrogen atoms. These atoms may preferably be in a content of from $1\times10^{-5}$ atomic % to 10 atomic %, more preferably from $1\times10^{-4}$ atomic % to 8 atomic %, and still more preferably from 1 atomic %$\times10^{-3}$ to 5 atomic %, in total based on the total of the silicon atoms, carbon atoms, oxygen atoms and nitrogen atoms in the photoconductive layer.

These carbon atoms, oxygen atoms and nitrogen atoms must be contained in and throughout the photoconductive layer and also in a uniform density distribution, but may have non-uniform density distribution at some part in the layer thickness direction. However, even when having non-uniform density distribution at some part, in order to make the effect of their incorporation uniformly effective, the above atoms must be contained all over and also in a uniform density distribution in the in-plane direction parallel to the surface of the support.

Materials capable of feeding carbon atoms may include, as effective materials, gaseous or gasifiable hydrocarbons such as $CH_4$, $C_2H_2$, $C_2H_6$, $C_3H_8$ and $C_4H_{10}$. In view of readiness in handling at the time of layer formation, and C-feeding efficiency, the materials may preferably include $CH_4$, $C_2H_2$ and $C_2H_6$. These material gases capable of feeding carbon atoms may be used optionally after their dilution with a gas such as $H_2$, He, Ar or Ne.

Materials capable of feeding nitrogen or oxygen may include gaseous or gasifiable compounds such as $NH_3$, NO, $N_2O$, $NO_2$, $O_2$, CO, $CO_2$ and $N_2$. These nitrogen- or oxygen-feeding material gases may be used optionally after their dilution with a gas such as $H_2$, He, Ar or Ne.

In order to form the photoconductive layer that has the desired film properties for achieving the object of the present invention, the mixing proportion of the material gas capable of feeding Si (hereinafter "Si-feeding gas") and dilute gas, the gas pressure inside the reactor, the discharge power and the support temperature must be appropriately set as desired.

The flow rate of $H_2$ or He, or a mixed gas of $H_2$ and He optionally used as dilute gas may be appropriately selected within an optimum range in accordance with the designing of photoconductive layer configuration, and the dilute gas may be mixed within the range of usually from 3 to 20 times, preferably from 4 to 15 times, and more preferably from 5 to 10 times, based on the Si-feeding gas.

The gas pressure inside the reactor may also be appropriately selected within an optimum range in accordance with the designing of layer configuration. The pressure may be in the range of usually from $1\times10^{-4}$ Torr to 10 Torr ($1.333\times10^{-2}$ Pa to $1.333\times10^{3}$ Pa), preferably from $5\times10^{-4}$ Torr to 5 Torr ($6.665\times10^{-2}$ Pa to $6.665\times10^{2}$ Pa), and more preferably from $1\times10^{-3}$ Torr to 1 Torr ($1.333\times10^{-1}$ Pa to $1.388\times10^{2}$ Pa).

The discharge power may also be appropriately selected within an optimum range in accordance with the designing of layer configuration, where the ratio (W/SCCM) of the discharge power to the flow rate of the Si-feeding gas may preferably be set within the range of from 3 to 8, more preferably from 4 to 6. In addition, the ratio of the discharge power to the flow rate of the Si-feeding gas in the formation of the second layer region may preferably be set larger than the ratio in the formation of the first layer region, and be formed at what is called the flow-limit region.

The temperature of the support may be set at usually from 200° C. to 350° C., more preferably from 280° C. to 330° C., and still more preferably from 250° C. to 300° C.

Preferable ranges of conditions as described above for the mixing ratio of Si-feeding gas and dilute gas, the gas pressure inside the reactor, the discharge powder and the support temperature can not be independently separately determined. Optimum conditions are appropriately determined on the basis of mutual and systematic relationship so that light-receiving members having the desired properties can be formed.

The support used in the present invention may be a conductive support or a support comprising an electrically insulating material whose surface has been subjected to conductive treatment at least on the side where the photoconductive layer is formed, either of which may be used. The conductive support may include those made of a metal such as Al, Cr, Mo, Au, In, Nb, Te, V, Ti, Pt, Pd or Fe, or an alloy of any of these, as exemplified by stainless steel. The electrically insulating material for the support subjected to conductive treatment may include a film or sheet of synthetic resin such as polyester, polyethylene, polycarbonate, cellulose acetate, polypropylene, polyvinyl chloride, polystyrene or polyamide, or glass or ceramic.

The support used in the present invention may have the shape of a cylinder or a sheet-like endless belt having a smooth plane or uneven surface. The thickness of the support may be appropriately determined as desired. In instances in which a flexibility is required as an electrophotographic light-receiving member, the support may be made as thin as possible so long as it can well function as a support. In usual instances, however, the support may have a thickness of 10 μm or more in view of its manufacture and handling, mechanical strength or the like.

When images are recorded using coherent light such as laser light, the surface of the support used in the present invention may be made uneven, whereby any faulty images due to what is called interference fringes appearing in visible images can be more effectively canceled. The unevenness made on the surface of the support can be produced by the known methods as disclosed in Japanese Patent Application Laid-open No. 60-168156, No. 60-178457 and No. 60-225854.

As another method for making the surface uneven, a plurality of sphere-traced concavities may be made on the surface of the support. In the unevenness thus formed, the surface of the support has a finer unevenness than the resolving power required for the light-receiving member. The unevenness thus formed can be produced by the known method as disclosed in Japanese Patent Application Laid-open No. 61-231561.

On the photoconductive layer of the light-receiving member of the present invention, a surface layer may preferably be superposingly formed which is formed of an amorphous material mainly composed of silicon atoms and containing at least one kind of carbon atoms, oxygen atoms and nitrogen atoms.

These carbon atoms, oxygen atoms and nitrogen atoms must be contained in and throughout the photoconductive layer and also in a uniform density distribution, but may have non-uniform density distribution at some part in the layer thickness direction. However, even when having non-uniform density distribution at some part, in order to make the effect of their incorporation uniformly effective, the above atoms must be contained all over and also in a uniform density distribution in the in-plane direction parallel to the surface of the support.

Figure 3:
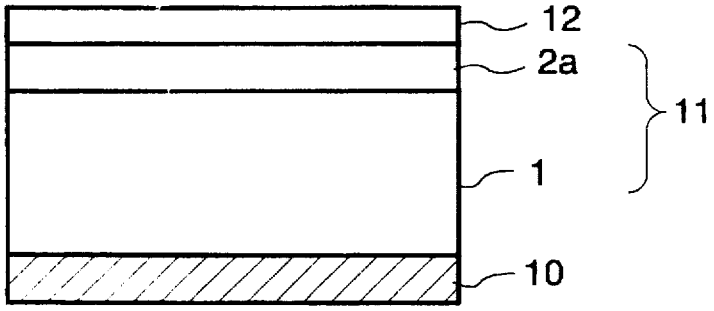
FIG. 3 is a diagrammatic cross section showing another example of layer configuration in the light-receiving member according to the present invention, having a surface layer.

FIG. 3 illustrates (diagrammatic cross section) an example of the layer configuration of a light-receiving member having the surface layer. A photoconductive layer 11 is superposed on the surface of a support 10, and a surface layer 12 is superposingly formed on this photoconductive layer. In the example shown in FIG. 3, the photoconductive layer 11 has a first layer region 1 and a second layer region 2*a* superposingly formed on the first layer region (similarly to FIG. 2A). Alternatively, it may have the layer configuration as shown in FIG. 2B or FIG. 2C.

When the surface layer is formed in the present invention, it may preferably be formed in a thickness of from 0.01 μm to 3 μm, more preferably from 0.05 μm to 2 μm, and still more preferably from 0.1 μm to 1 μm. If the layer thickness is smaller than 0.01 μm, the surface layer tends to become immediately lost because of friction or the like during the use of the light-receiving member. If it is larger than 3 μm, a lowering of electrophotographic performance such as an increase in residual potential may occur.

The surface layer as described above has a free surface, and is provided in order to improve moisture resistance, performance on continuous repeated use, electrical breakdown strength, service environmental properties and running performance. Like the photoconductive layer, this surface layer is formed using a non-single-crystal material, in particular, an amorphous material, mainly composed of silicon atoms, and hence a chemical and structural stability is well ensured at the interface between the superposed layers.

The surface layer in the present invention may be formed using any materials so long as they are non-single-crystal silicon materials, in particular, amorphous materials mainly composed of silicon atoms (i.e., amorphous silicon materials). For example, it is preferable to use an amorphous silicon material containing hydrogen atoms and/or halogen atoms (hereinafter "a-Si:X"). In addition, it is more preferable to use an a-Si:X containing at least one kind of carbon atoms, oxygen atoms and nitrogen atoms. In particular, an a-Si:X containing carbon atoms is most preferred. When the surface layer is formed using as a main constituent the a-Si:X containing carbon atoms, the carbon content in the surface layer may preferably be within the range of from 30 atomic % to 90 atomic % based on the total number of silicon atoms and the number of carbon atoms.

The surface layer in the present invention is required to contain hydrogen atoms or halogen atoms. It may also contain both hydrogen atoms and halogen atoms. When hydrogen atoms are incorporated, it is suitable to control the hydrogen atoms so as to be in a content of from 30 atomic % to 70 atomic %, preferably from 35 atomic % to 65 atomic %, and more preferably from 40 atomic % to 60 atomic %, based on the total of the constituent atoms. When halogen atoms are incorporated, it is suitable to control the halogen atoms so as to be in a content of from 0.01 atomic % to 15 atomic %, preferably from 0.1 atomic % to 10 atomic %, and more preferably from 0.6 atomic % to 4 atomic %, based on the total of the constituent atoms.

Controlling their content in this way makes it possible to compensate dangling bonds of silicon atoms and to improve layer quality, in particular, to improve photoconductivity and charge retentivity.

Light-receiving members for electrophotography have problems as stated below. For example, charging performance may deteriorate because of the injection of charges from the free surface; charging performance may vary because of changes in surface structure in a service environment, e.g., in an environment of high humidity; and the injection of charges into the surface layer from the photoconductive layer at the time of corona discharging or irradiation with light may cause a phenomenon of after-images during repeated use because of entrapment of charges in the defects inside the surface layer. These are known to be caused by any defects or imperfections (mainly comprised of dangling bonds of silicon atoms or carbon atoms) present inside the surface layer.

However, the incorporation of hydrogen atoms in the surface layer and the controlling of hydrogen atom content in the surface layer so as to be 30 atomic % to 70 atomic % brings about a great decrease in the defects inside the surface layer, so that improvements can be achieved in respect of electrical properties and high-speed continuous-use performance. If the hydrogen atoms are in a content less than 30 atomic %, the above effects can not be well achieved in some cases. If on the other hand the hydrogen atoms are in a content more than 70 atomic %, the hardness of the surface layer may lower, and hence the layer can not endure the repeated use in some cases. The hydrogen atom content in the surface layer can be controlled according to the flow rate and ratio of material gases, the support temperature, the discharge power, the gas pressure and so forth at the time of manufacture described later.

The incorporation of halogen atoms in the surface layer and the controlling of halogen atoms in the surface layer so as to be in a content of from 0.01 atomic % to 15 atomic % makes it possible to more effectively achieve the formation of bonds between silicon atoms and carbon atoms in the surface layer. Also, the halogen atoms in the surface layer can effectively prevent the bonds between silicon atoms and carbon atoms from breaking because of corona discharge or the like. If the halogen atoms are in a content less than 0.01 atomic % or more than 15 atomic %, the above effects can not be well achieved in some cases. When the halogen atoms are in a content more than 15 atomic %, residual potential and image memory may become remarkably seen because the excessive halogen atoms inhibit the mobility of carriers in the surface layer. The halogen atom content in the surface layer can be controlled like the control of hydrogen atom content, according to the flow rate and ratio of material gases, the support temperature, the discharge power, the gas pressure and so forth.

The surface layer in the present invention can be formed in the same manner as the formation of the photoconductive layer previously described. For example, when the surface layer comprising an a-Si:X containing carbon atoms is formed by glow discharging, usually a material gas capable of feeding silicon atoms, a material gas capable of feeding carbon atoms and a material gas capable of feeding hydrogen atoms and/or a material gas capable of feeding halogen atoms may be introduced in the desired gaseous state into a reactor whose inside can be evacuated, and glow discharge may be caused to take place in the reactor so that the surface layer is formed on the photoconductive layer on the support previously set at a given position.

The materials capable of feeding silicon atoms, carbon atoms, oxygen atoms and nitrogen atoms may be the same as those in the case of the photoconductive layer. As the material capable of feeding hydrogen atoms, $H_2$ gas, a mixed gas of $H_2$ and He or a gas of a silicon compound containing hydrogen atoms may be used. These material gases are mixed with other gases in necessary quantities when used. This makes it more easy to control the proportion of incorporating hydrogen atoms in the surface layer. As the material capable of feeding halogen atoms, the same materials as used in the photoconductive layer may be used. The above material gases may each be used alone or in the form of a mixture of two or more species.

In order to control the quantity of the hydrogen atoms and/or halogen atoms incorporated in the surface layer, it can be controlled in the same manner as in the case of the photoconductive layer.

The surface layer in the present invention, like the photoconductive layer previously described, may preferably be incorporated with atoms capable of controlling its conductivity.

The atoms capable of controlling the conductivity must be contained in and throughout the surface layer and also in a uniform density distribution, but may have non-uniform density distribution at some part in the layer thickness direction. However, even when having non-uniform density distribution at some part, in order to make the effect of their incorporation uniformly effective, the above atoms must be contained all over and also in a uniform density distribution in the in-plane direction parallel to the surface of the support.

The atoms capable of controlling the conductivity may preferably be contained in the surface layer in an amount of from $1\times10^{-3}$ atomic ppm to $1\times10^{3}$ atomic ppm, more preferably from $1\times10^{-2}$ atomic ppm to $5\times10^{2}$ atomic ppm, and still more preferably from $1\times10^{-1}$ atomic ppm to $1\times10^{2}$ atomic ppm.

Kinds of the atoms capable of controlling the conductivity, starting materials therefor, and the manner of incorporating the atoms into the surface layer may be the same as those in the case of the photoconductive layer previously described.

In order to form the surface layer that has the desired film properties for achieving the object of the present invention, the mixing proportion of Si-feeding gas and dilute gas, the gas pressure inside the reactor, the discharge power and the support temperature must be appropriately set as desired. With regard to gas pressure inside the reactor and support temperature, they may be set in the same manner as in the case of the photoconductive layer.

The surface layer in the present invention that is formed in the manner as described above is carefully formed so that the required performances can be imparted as desired. More specifically, from the structural viewpoint, the surface layer having, as its constitutents, silicon atoms, at least one kind of carbon atoms, oxygen atoms and nitrogen atoms, and hydrogen atoms and/or halogen atoms takes the form of from crystalline to amorphous depending on the conditions for its formation. From the viewpoint of electric properties, it exhibits the nature of from conductive to semiconductive and up to insulating, and also the nature of from photoconductive to non-photoconductive. Accordingly, the conditions for its formation are severely selected so that a surface layer having the desired properties can be formed. For example, when the surface layer is provided mainly for the purpose of improving its breakdown strength, the surface layer is formed in an amorphous form having a remarkable electrical insulating behavior in the service environment. When the surface layer is provided mainly for the purpose of improving the performance on continuous repeated use and service environmental properties, it is formed in an amorphous form having become lower in its degree of the above electrical insulating properties to a certain extent and having a certain sensitivity to the light with which the layer is irradiated.

The light-receiving member of the present invention may have, between the photoconductive layer and the surface layer, a blocking layer (a lower surface layer) having a smaller content of carbon atoms, oxygen atoms and nitrogen atoms than the surface layer. This enables more improvement in performances such as charge performance.

In the surface layer at the vicinity region of the interface between the surface layer and photoconductive layer, there may be provided with a region in which the content of carbon atoms, oxygen atoms and nitrogen atoms decreases toward the photoconductive layer. This makes it possible to improve the adhesion between the surface layer and the photoconductive layer, smoothly move photocarriers to the surface, and more decrease an interference due to reflected light at the interface between the photoconductive layer and the surface layer.

In the light-receiving member of the present invention, it is preferable to have a charge injection blocking layer mainly composed of silicon atoms and containing at least one kind of carbon atoms, oxygen atoms and nitrogen atoms and atoms capable of controlling conductivity, and to have the photoconductive layer superposingly formed on this charge injection blocking layer. More specifically, when the charge injection blocking layer, which has the function to prevent charges from being injected from the conductive support side, is provided between the conductive support and the photoconductive layer, the object of the present invention can be made more effectively achievable. In this instance, there is no limitation on the presence or absence of the surface layer. More preferably, the surface layer may be superposingly formed on the photoconductive layer.

Figure 4:
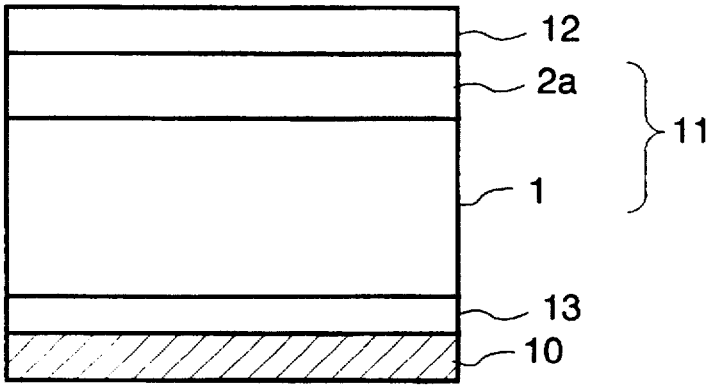
FIG. 4 is a diagrammatic cross section showing an example of layer configuration in the light-receiving member according to the present invention, having a charge injection blocking layer and a surface layer.

FIG. 4 illustrates (diagrammatic cross section) an example of the layer configuration of a light-receiving member having the charge injection blocking layer and the surface layer. A charge injection blocking layer 13 is superposed on the surface of a support 10, a photoconductive layer 11 is superposingly formed on the charge injection blocking layer 13, and a surface layer 12 is superposingly formed on this photoconductive layer. In the example shown in FIG. 4, the photoconductive layer 11 has a first layer region 1 and a second layer region 2*a* superposingly formed thereon (similary to FIG. 2A). Alternatively, it may have the layer configuration as shown in FIG. 2B or FIG. 2C.

The charge injection blocking layer in the present invention may preferably be formed in a thickness of from 0.1 μm to 5 μm, more preferably from 0.3 μm to 4 μm, and more preferably from 0.5 μm to 3 μm. If the layer thickness is smaller than 0.1 μm, the effect of the charge injection blocking layer can not be well brought about in some cases. If on the other hand it is larger than 5 μm, any desired improvement in electrophotographic performance that may be expected by making the thickness larger may not be achieved, and an increase in production cost may result because of prolongation of the time for film formation.

The charge injection blocking layer in the present invention has the function to prevent charges from being injected from the support side to the photoconductive layer side when the light-receiving member is subjected to charging in a certain polarity, and exhibits no such function when subjected to charging in a reverse polarity, which is called polarity dependence.

In order to impart such function, atoms capable of controlling its conductivity must be incorporated in the charge injection blocking layer. When such atoms capable of controlling conductivity is incorporated also in the photoconductive layer, their content in the charge injection blocking layer must be made larger than that in the photoconductive layer.

The atoms capable of controlling the conductivity must be contained in and throughout the charge injection blocking layer and also in a uniform density distribution, but may have non-uniform density distribution at some part in the layer thickness direction. The part where the density distribution is non-uniform may preferably be more distributed on the support side. However, even when having non-uniform density distribution at some part, in order to make the effect of their incorporation uniformly effective, the above atoms must be contained all over and also in a uniform density distribution in the in-plane direction parallel to the surface of the support.

The atoms capable of controlling the conductivity may preferably be contained in the surface layer in an amount of from 10 atomic ppm to $1\times10^4$ atomic ppm, more preferably from 50 atomic ppm to $5\times10^3$ atomic ppm, and still more preferably from $1\times10^2$ atomic ppm to $3\times10^3$ atomic ppm.

Kinds of the atoms capable of controlling the conductivity, starting materials therefor, and the manner of incorporating the atoms into the charge injection blocking layer may be the same as those in the case of the photoconductive layer previously described.

In the present invention, it is also effective to incorporate in the charge injection blocking layer at least one kind of carbon atoms, oxygen atoms and nitrogen atoms. These atoms may preferably be in a content of from $1\times10^{-3}$ atomic % to 30 atomic %, more preferably from $5\times10^{-3}$ atomic % to 20 atomic %, and still more preferably from $1\times10^{-2}$ atomic % to 10 atomic %, in total based on the total of the silicon atoms, carbon atoms, oxygen atoms and nitrogen atoms in the charge injection blocking layer.

These carbon atoms, oxygen atoms and nitrogen atoms must be contained in and throughout the charge injection blocking layer and also in a uniform density distribution, but may have non-uniform density distribution at some part in the layer thickness direction. However, even when having non-uniform density distribution at some part, in order to make the effect of their incorporation uniformly effective, the above atoms must be contained all over and also in a uniform density distribution in the in-plane direction parallel to the surface of the support.

Incorporation of at least one kind of carbon atoms, oxygen atoms and nitrogen atoms in this way enables more improvement in adhesion to other layers provided in contact with the charge injection blocking layer.

The charge injection blocking layer in the present invention may be formed using an amorphous material mainly composed of silicon atoms (amorphous silicon material) optionally containing the above atoms. As this amorphous silicon material, it is preferable to use an amorphous silicon material containing hydrogen atoms and/or halogen atoms (a-Si:X). The hydrogen atoms and/or halogen atoms in the layer have the same effect as in the case of the photoconductive layer and surface layer previously described.

The hydrogen atoms and/or halogen atoms in the charge injection blocking layer may preferably be in a content of from 1 atomic % to 50 atomic %, more preferably from 5 atomic % to 40 atomic %, and still more preferably from 10 atomic % to 30 atomic %, based on the total of the silicon atoms and hydrogen atoms and/or halogen atoms.

The materials capable of feeding silicon atoms, carbon atoms, oxygen atoms and nitrogen atoms may be the same as those in the case of the photoconductive layer. As the material capable of feeding hydrogen atoms, $H_2$ gas, a mixed gas of $H_2$ and He or a gas of a silicon compound containing hydrogen atoms may be used. These material gases are mixed with other gases in necessary quantities when used. This makes it more easy to control the proportion of incorporating hydrogen atoms in the charge injection blocking layer. As the material capable of feeding halogen atoms, the same materials as used in the photoconductive layer may be used. The above material gases may each be used alone or in the form of a mixture of two or more species.

The charge injection blocking layer in the present invention is formed by the thin-film vacuum deposition previously described and in the same manner as the formation of the photoconductive layer.

In order to form the charge injection blocking layer that has the desired film properties for achieving the object of the present invention, the mixing proportion of Si-feeding gas and dilute gas, the gas pressure inside the reactor, the discharge power and the support temperature must be appropriately set as desired. With regard to the discharge power, the ratio of the discharge power to the flow rate of the Si-feeding gas may preferably be set within the range of from 0.5 to 8, more preferably from 0.8 to 7 and still more preferably from 1 to 6. The mixing proportion of Si-feeding gas and dilute gas, the gas pressure inside the reactor and the support temperature may be set in the same manner as in the case of the photoconductive layer.

In the photoconductive layer of the light-receiving member according to the present invention, aluminum atoms, silicon atoms and hydrogen atoms and/or halogen atoms may preferably be non-uniformly distributed in the layer thickness direction (i.e., composed mainly of aluminum atoms on the support side and mainly of silicon atoms gradually toward the surface). This brings about an improvement in adhesion at the interface between the support and the photoconductive layer (in particular, the charge injection blocking layer) to cause minute peeling and cracks with difficulty, and also a gradual change of composition to allow carriers to smoothly flow from the photoconductive layer to the support, resulting in an improvement in image quality.

An adherent layer may also be provided between the support and the photoconductive layer or, when the charge injection blocking layer is provided, between the charge injection blocking layer and the support. This adherent layer more improves the adhesion to the support. Such an adherent layer is formed of, e.g., $Si_3N_4$, $SiO_2$, SiO, or an amorphous material mainly composed of silicon atoms and containing hydrogen atoms and/or halogen atoms and at least one kind of carbon atoms, oxygen atoms and nitrogen atoms.

A light absorption layer (e.g., an IR absorption layer) may also be provided between the support and the photoconductive layer or, when the charge injection blocking layer is provided, between the charge injection blocking layer and the support. This light absorption layer can prevents occurrence of interference fringes due to the light reflected from the support.

Apparatus for forming an electrophotographic light-receiving member according to the present invention and film forming methods for forming the above respective layers by using the apparatus will be described below in detail.

Figure 5:
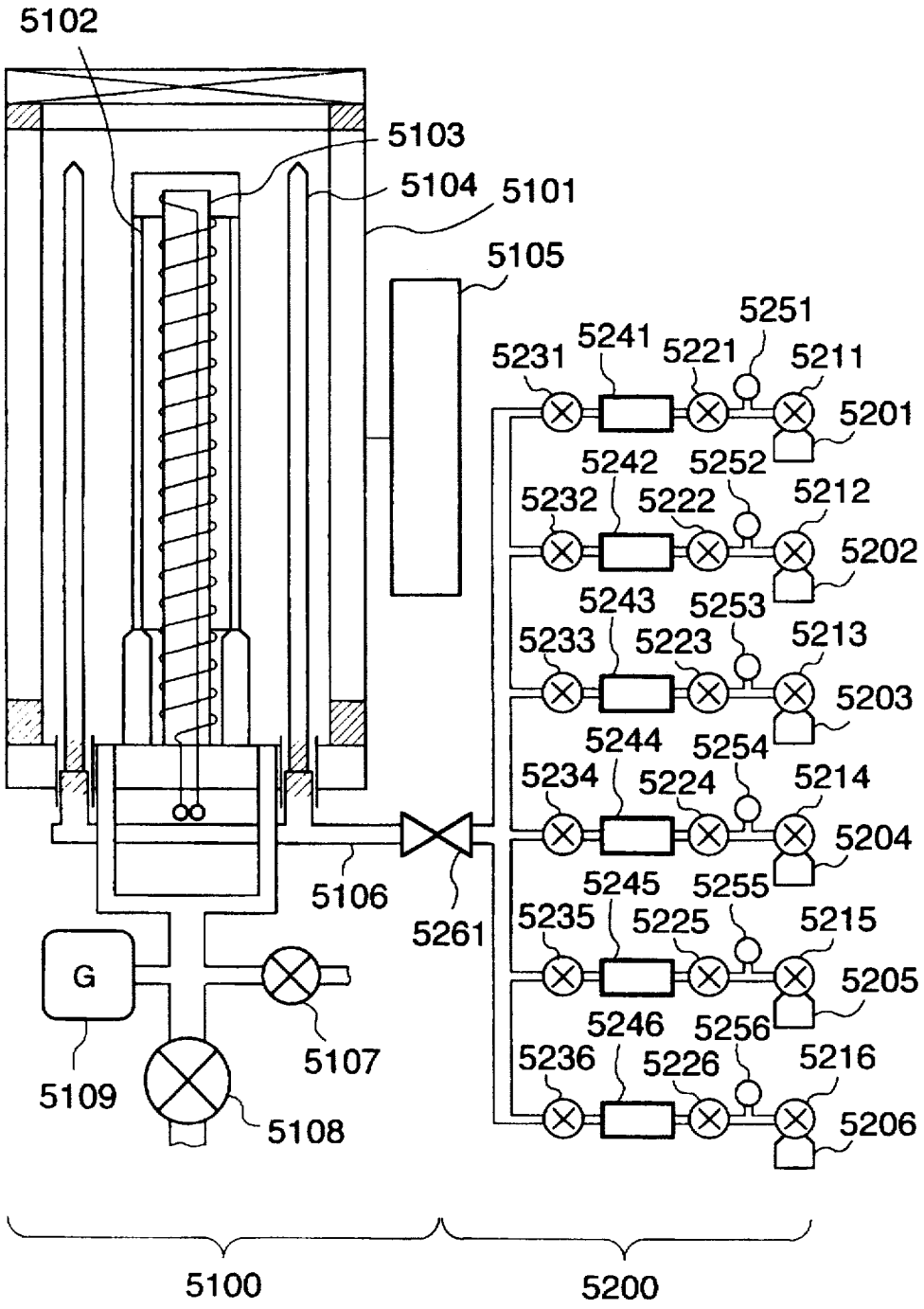
FIG. 5 schematically illustrates the constitution of a production apparatus used when films are formed by high-frequency plasma-assisted chemical vapor deposition making use of an RF band as power source frequency (RF-PCVD).

FIG. 5 diagrammatically illustrates an example of an apparatus for producing the light-receiving member by high-frequency plasma-assisted CVD making use of RF bands as power source frequencies (hereinafter "RF-PCVD"), which is one of glow discharging. The production apparatus shown in FIG. 5 is constituted in the following way.

This production apparatus is constituted chiefly of a deposition system 5100, a material gas feed system 5200 and an exhaust system (not shown) for evacuating the inside of a reactor 5101. In the reactor 5101 in the deposition system 5100, a cylindrical support 5102, a support heater 5103 and a material gas feed pipe 5104 are provided. A high-frequency matching box 5105 is also connected to the reactor.

The cylindrical support may be heated by any means so long as it is a heating element of a vacuum type. Such a heater for heating supports may specifically include electrical resistance heaters such as a sheathed-heater winding heater, a plate heater and a ceramic heater, heat radiation lamp heating elements such as a halogen lamp and an infrared lamp, and heating elements comprising a heat exchange means employing a liquid, gas or the like as a hot medium. As surface materials of the heating means, metals such as stainless steel, nickel, aluminum and copper, ceramics, heat-resistant polymer resins or the like may be used. As another method, a container exclusively used for heating may be provided in addition to the reactor and the support may be once heated therein and thereafter transported into the reactor. Such a method may be used.

The material gas feed system 5200 is constituted of gas cylinders 5201 to 5206, pressure controllers 5251 to 5256 provided corresponding to the cylinders, respectively, line valves 5211 to 5216, 5221 to 5226 and 5231 to 5236, and mass flow controllers 5241 to 5246. The line of the gas cylinders for the respective material gases are connected to a gas feed pipe 5104 in the reactor 5101 through a material gas pipe 5106 via an auxiliary valve 5261.

The formation of films by RF-PCVD using the production apparatus shown in FIG. 5 can be carried out, e.g., in the following way.

The cylindrical support 5102 is first set in the reactor 5101, and the inside of the reactor 5101 is evacuated by means of an exhaust device (not shown; e.g., a vacuum pump). Subsequently, the temperature of the cylindrical support 5102 is controlled at a predetermined temperature of, e.g., from 200° C. to 350° C. by means of the heater 5103 for heating the support. The temperature may preferably set at 230° C. to 330° C., and more preferably from 250° C. to 310° C.

Before material gases for forming films are flowed into the reactor 5101, gas cylinder valves 5211 to 5216 and a leak valve 5107 of the reactor are checked to make sure that they are closed, and also flow-in valves 5221 to 5226, flow-out valves 5231 to 5236 and an auxiliary valve 5261 are checked to make sure that they are opened.

Then, a main discharge valve 5108 is opened to evacuate the insides of the reactor 5101 and a gas pipe 5106. At the time a vacuum gauge (G) 5109 has been read to indicate a pressure of about $5\times10^{-6}$ Torr, the auxiliary valve 5261 and the flow-out valves 5231 to 5236 are closed.

Thereafter, gas cylinder valves 5211 to 5216 are opened so that gases are respectively introduced from gas cylinders 5201 to 5206 into the reactor 5101, and each gas is controlled to have a pressure of about 2 kg/cm$^2$ by operating pressure controllers 5251 to 5256. Next, the flow-in valves 5221 to 5226 are slowly opened so that gases are respectively introduced into mass flow controllers 5241 to 5246.

After the film formation is thus ready to start, the respective layers are formed according to the following procedure.

At the time the cylindrical support 5102 has had a predetermined temperature, some necessary flow-out valves 5231 to 5236 and the auxiliary valve 5261 are slowly opened so that predetermined gases are fed into the reactor 5101 from the gas cylinders 5201 to 5206 through a gas feed pipe 5104. Next, the mass flow controllers 5241 to 5246 are operated so that each material gas is adjusted to flow at a predetermined rate. In that course, the main discharge valve 5108 is so adjusted that the pressure inside the reactor 5101 comes to be a predetermined pressure of not higher than 1 Torr, while watching the vacuum gauge 5109.

At the time the inner pressure has become stable, an RF power source (not shown) with a frequency of, e.g., 13.56 MHz is set at the desired electric power, and an RF power is supplied to the inside of the reactor 5101 through the matching box 5105 to cause glow discharge to take place. The material gases fed into the reactor are decomposed by the discharge energy thus produced, so that a film mainly composed of silicon is formed on the cylindrical support 5102. After a film with a desired thickness (layer thickness) has been formed, the supply of RF power is stopped, and the flow-out valves are closed to stop gases from flowing into the reactor. The formation of a film is thus completed.

The above operation is repeated plural times, whereby an electrophotographic light-receiving member with the desired multi-layer structure can be formed.

When the corresponding layers are formed, the flow-out valves other than those for necessary gases must be all closed. Also, in order to prevent the corresponding gases from remaining in the reactor 5101 and in the pipe extending from the flow-out valves 5231 to 5236 to the reactor 5101, the flow-out valves 5231 to 5236 are closed, the auxiliary valve 5261 is opened and then the main discharge valve 5108 is full-opened so that the inside of the system is once evacuated to a high vacuum; this may be optionally operated.

In order to achieve uniform film formation, it is effective to rotate the cylindrical support 5102 at a predetermined speed by means of a driving mechanism (not shown) while the films are formed.

Needless to say, the above procedure may be altered according to the conditions under which each layer is formed.

A process for producing electrophotographic light-receiving members by high-frequency plasma-assisted CVD making use of VHF bands as power source frequencies (hereinafter "VHF-PCVD") will be described below.

Figure 6:
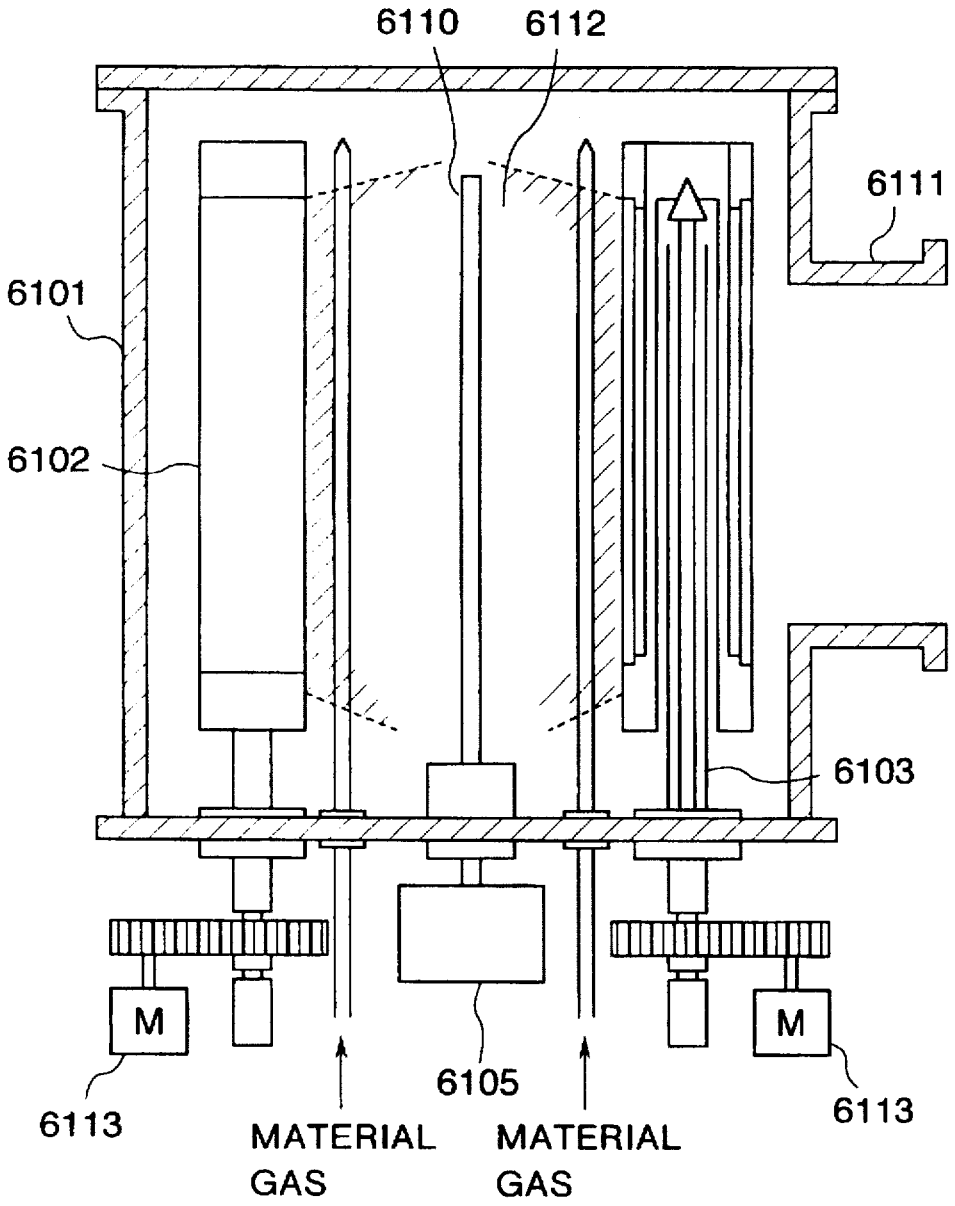
FIG. 6 schematically illustrates the constitution of a deposition system of a production apparatus used when films are formed by high-frequency plasma-assisted chemical vapor deposition making use of a VHF band as power source frequency (VHF-PCVD).

The deposition system 5100 in the production apparatus shown in FIG. 5 is replaced with the deposition system 5200 as shown in FIG. 6, to connect it to the material gas feed system 5200. Thus, a production apparatus used in VHF-PCVD is set up.

This production apparatus is constituted chiefly of a deposition system (see FIG. 6), a material gas feed system (5200 in FIG. 5) and an exhaust system (not shown) for evacuating the inside of the reactor. In the deposition system shown in FIG. 6, cylindrical supports 6102, support heaters 6103, a material gas feed pipe (not shown) and an electrode 6110 are provided in a reactor 6101. A matching box 6105 is also connected to the electrode. The reactor 6101 has an exhaust tube 6111 and is connected to an exhaust system (not shown) through it. In the reactor, space surrounded by the cylindrical supports 6102 forms a discharge space 6112. Support rotating motors (M) 6113 for rotating the cylindrical supports are provided outside the reactor. The cylindrical supports are heated by the same methods as in the case of the RF-PCVD.

As the material gas feed system connected to the deposition system, the same system as the material gas feed system 5200 shown in FIG. 5 may be used.

The formation of films by VHF-PCVD using this production apparatus can be carried out in the following way.

First, cylindrical supports 6102 are set in the reactor 6101. While the cylindrical supports 6102 are each rotated by means of a support rotating motor 6113, the inside of the reactor is evacuated through the exhaust tube 6111 by means of an exhaust device (not shown) as exemplified by a diffusion pump, to control the pressure inside the reactor to be not higher than, e.g., $1\times10^{-7}$ Torr. Subsequently, the temperature of each cylindrical support is kept by heating at a predetermined temperature of from 200° C. to 350° C. by means of the support heater 6103. The temperature is set to be preferably from 230° C. to 330°, more preferably 250° C. to 310° C.

Next, valve operation and evacuation are carried out in the same manner as in the case of the RF-PCVD described above, to feed film-forming materials gases into the reactor 6101.

After the film formation is thus ready to start, the respective layers are formed according to the following procedure.

At the time each cylindrical support 6102 has had a predetermined temperature, some necessary flow-out valves and the auxiliary valve are slowly opened so that stated gases are fed into the reactor 6101 from the gas cylinders through the gas feed pipe to fill the discharge space 6112 with gas. Next, the mass flow controllers are operated so that each material gas is adjusted to flow at a predetermined rate. In that course, the main discharge valve is so adjusted that the pressure inside the discharge space 6112 comes to be a predetermined pressure of not higher than 1 Torr, while watching the vacuum gauge.

At the time the inner pressure has become stable, a VHF power source (not shown) with a frequency of, e.g., 500 MHz is set at the desired electric power, and a VHF power is supplied to the discharge space 6112 through a matching box 6105 to cause glow discharge to take place. Thus, in the discharge space 6112, the material gases fed into it are excited by discharge energy to undergo dissociation, so that the desired film is formed on each conductive support 6102. In this course, the support is rotated at the desired rotational speed by means of the support rotating motor 6113 so that the layer can be uniformly formed. After a film with the desired thickness has been formed, the supply of VHF power is stopped, and the flow-out valves are closed to stop gases from flowing into the reactor. The formation of deposited films is thus completed.

The above operation is repeated plural times, whereby electrophotographic light-receiving layers with the desired multi-layer structure can be formed.

When the corresponding layers are formed, like the case of the RF-PCVD, the flow-out valves other than those for necessary gases must be all closed. Also, in order to prevent the corresponding gases from remaining in the reactor and in the pipe extending from the flow-out valves to the reactor, the flow-out valves are closed, the auxiliary valve is opened and then the main discharge valve is full-opened so that the inside of the system is once evacuated to a high vacuum; this may be optionally operated.

Needless to say, the above procedure may be altered according to the conditions under which each layer is formed.

The pressure in the discharge space in the VHF-PCVD may preferably be set at from 1 mTorr ($1.333\times10^{-1}$ Pa) to 500 mTorr ($6.665\times10^{1}$ Pa), more preferably from 3 mTorr ($3.999\times10^{-1}$ Pa) to 300 mTorr ($3.999\times10^{1}$ Pa), and still more preferably from 5 mTorr ($6.665\times10^{-1}$) to 100 mTorr ($1.333\times10^{1}$ Pa).

In the production apparatus employing VHF-PCVD, the electrode provided in the discharge space may have any size and shape so long as it may cause no disorder of discharge. In view of practical use, it may preferably have the cylindrical shape with a diameter of from 1 mm to 10 cm. Here, the length of the electrode may also be arbitrarily set so long as it is long enough for the electric field to be uniformly applied to the support. The electrode may be made of any material without limitation so long as its surface is conductive. For example, metals such as stainless steel, Al, Cr, Mo, Au, In, Nb, Te, V, Ti, Pt, Pb and Fe, alloys of any of these, or glass or ceramic whose surface has been conductive-treated with any of these are usually used.

The present inventors have took note of the behavior of carriers in the photoconductive layer, and have made extensive studies on the relationship between the localized-state density distribution of hydrogenated and/or halide amorphous silicon in bandgaps and the charging performance, temperature dependence thereof and exposure memory (light memory). As the result, they have achieved the object of the present invention by controlling, in the thickness direction of the photoconductive layer, the localized-state density distribution in bandgaps, i.e., controlling the hydrogen atom and/or halogen atom content (Ch), optical bandgaps (Eg) and characteristic energy (Eu), and also by superposingly forming two kinds of layer regions having difference values for these.

More specifically, the optical bandgap of the photoconductive layer is made larger and the rate of capture of carriers to localized levels is made smaller, whereby the charging performance can be greatly improved and at the same time its temperature dependency can be made lower, and also the exposure memory can be made substantially free from occurring. Coarse images can also be made less occur when certain layer configuration is employed.

The foregoing can be explained in greater detail as follws: In bandgaps of hydrogenated and/or halide amorphous silicon, there are commonly a tail (bottom) level ascribable to a structural disorder of Si—Si bonds and a deep level ascribable to structural imperfections of dangling bonds of Si or the like. These levels are known to act as capture and recombination centers of electrons and holes to cause a lowering of properties of devices.

As the cause of the temperature dependence of charging performance, i.e., the cause of a lowering of charging performance which occurs when the photosensitive member is heated by a drum heater or the like, it is considered as follows: Carriers thermally excited are led by electric fields formed at the time of charging to move toward the surface while repeating their capture to and release from the localized levels of band tails and deep localized levels in bandgaps, and consequently cancel surface charges. Here, the carriers reaching the surface during the charging little affect charging performance, but the carriers captured in the deep levels reach the surface after charging (after they have passed through the charging assembly), to cancel the surface charges to cause a lowering of charging performance. The carriers thermally excited after the charging also cancel the surface charges to cause a lowering of charging performance. In order to prevent this, it is necessary to hinder the thermally excited carriers from being produced and also to improve the mobility of carriers.

Accordingly, making the optical bandgap larger prevents the thermally excited carriers from being produced, and making small the rate of capture of carriers in localized levels improves the the mobility of carriers, so that the charging performance can be prevented from lowering.

As for the exposure memory (light memory), it is also caused when the photo-carriers produced by blank exposure or imagewise exposure are captured in the localized levels in bandgaps and the carriers remain in the photoconductive layer. More specifically, among photo-carriers produced in a certain process of copying, the carriers having remained in the photoconductive layer are swept out by the electric fields formed by surface charges, at the time of subsequent charging or thereafter, and the potential at the portions exposed to light become lower than other portions, so that a density difference occurs on images. In order to prevent this, the mobility of carriers must be improved so that they can move through the photoconductive layer at one process of copying without allowing the photo-carriers to remain in the layer as far as possible.

Thus, the layer in which the Ch is made greater, the Eg is made greater and also the Eu is controlled (decreased) is provided to thereby hinder the thermally excited carriers from being produced and also to decrease the proportion of thermally excited carriers or photo-carriers captured in the localized levels, so that the mobility of carriers can be dramatically improved.

The present invention will be described below in greater detail by giving Examples. The present invention is by no means limited to these.

EXAMPLE 1

An electrophotographic light-receiving member according to the present invention was produced by RF-PCVD using the production apparatus shown in FIG. 5. Layers were superposingly formed on a mirror-finished aluminum cylinder (support) of 80 mm diameter in the order of a charge injection blocking layer, a photoconductive layer and a surface layer, which were formed under conditions as shown in Table 1. Here, the photoconductive layer was formed of a first layer region and a second layer region, which were superposingly formed in this order from the side of the charge injection blocking layer.

The first layer region of the photoconductive layer had a hydrogen content (Ch) of 23 atomic %, an optical bandgap (Eg) of 1.77 eV and a characteristic energy (Eu) of 60 meV. The second layer region had a Ch of 32 atomic %, an Eg of 1.83 eV and an Eu of 53 meV. These results are values obtained by the method described later as "Measurement of Ch, Eg and Eu".

Performances of the light-receiving member thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially in respect of charging performance, temperature dependence and exposure memory, the present light-receiving member showed better performances than a light-receiving member having a photoconductive layer formed of only the first layer region.

TABLE 1

| Gas species/ Conditions | Charge injection blocking layer | Photoconductive layer First layer region | Photoconductive layer Second layer region | Surface layer |
|---|---|---|---|---|
| $SiH_4$ (SCCM) | 200 | 200 | 100 | 10 |
| $H_2$ (SCCM) | 300 | 1,000 | 800 | 0 |
| $B_2H_6$ (ppm) (based on $SiH_4$) | 2,000 | 2 | 1 | 0 |
| NO (SCCM) | 5 | 0 | 0 | 0 |
| $CH_4$ (SCCM) | 0 | 0 | 0 | 500 |
| Support temp. (°C.) | 290 | 290 | 280 | 280 |
| Pressure (Torr) | 0.5 | 0.5 | 0.5 | 0.5 |
| RF power (W) | 500 | 800 | 600 | 200 |
| Layer thickness (μm) | 3 | 28 | 2 | 0.5 |

In the present Example, various light-receiving members having different Ch, Eg and Eu in the second layer region were also produced in the same manner but changing the mixing ratio of $SiH_4$ to $H_2$, proportion of $SiH_4$ gas to discharge power and support temperature in the formation of the second layer region. Thickness of the first layer region and that of the second layer region were fixed at 28 μm and 2 μm, respectively.

Figure 7:
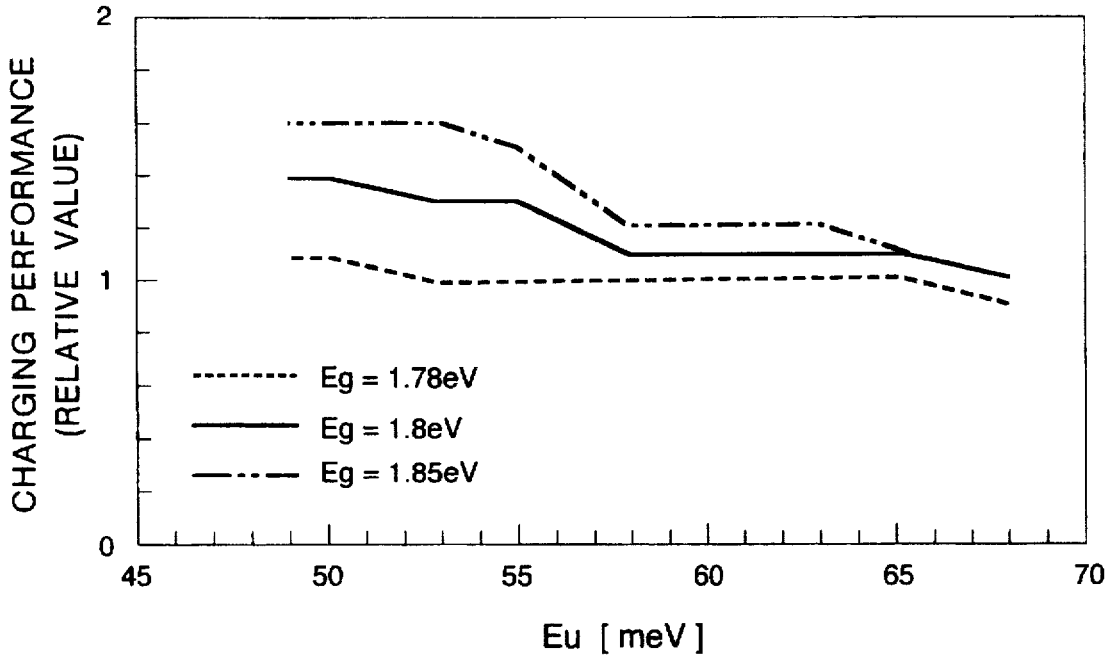
FIG. 7 is a graph showing the relationship between second layer region's Eu and light-receiving member charging performance at different Eg values in the second layer region of the photoconductive layer, with regard to the light-receiving member of the present invention.
Figure 8:
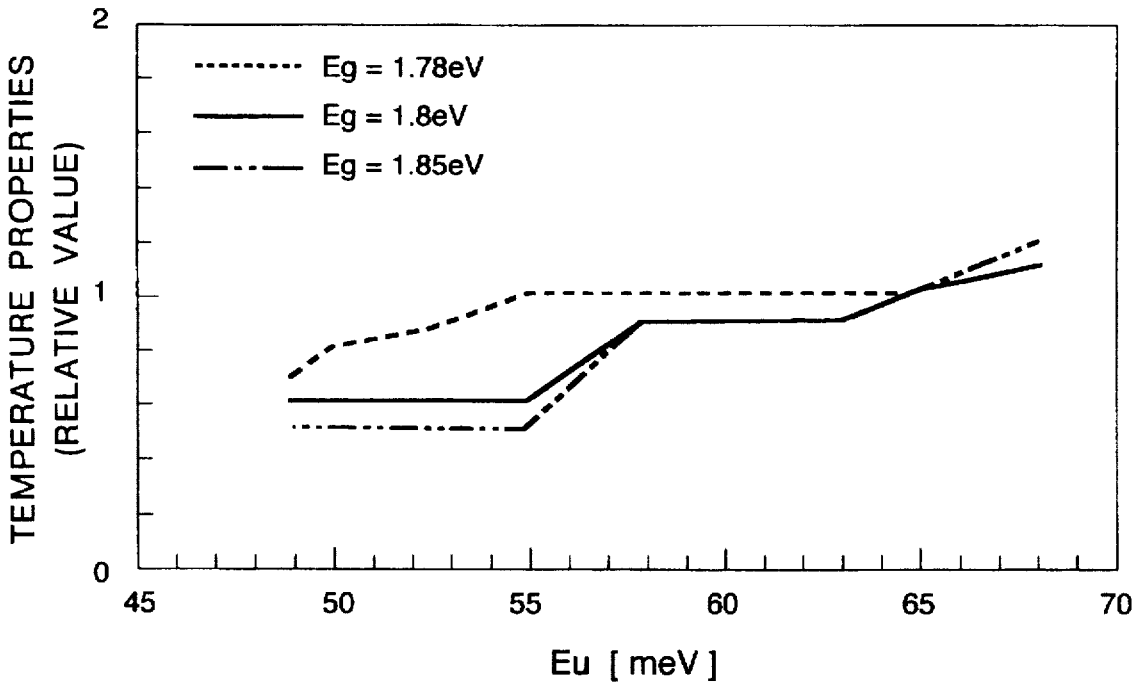
FIG. 8 is a graph showing the relationship between second layer region's Eu and light-receiving member temperature properties at different Eg values in the second layer region of the photoconductive layer, with regard to the light-receiving member of the present invention.
Figure 9:
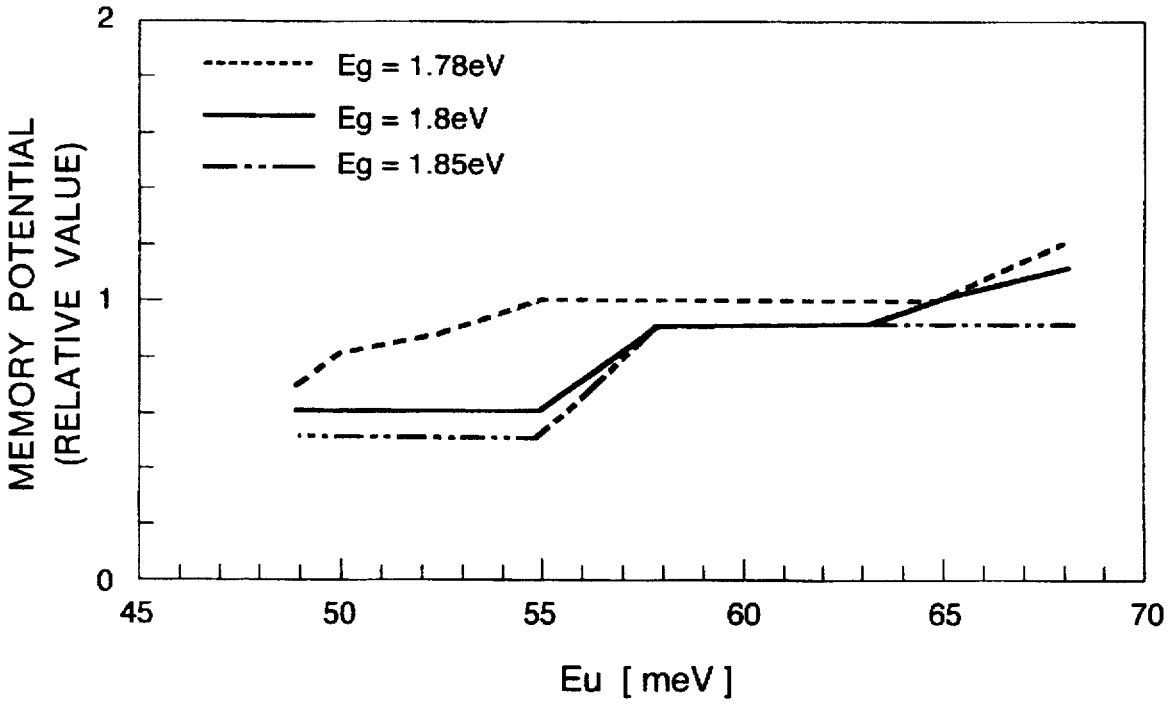
FIG. 9 is a graph showing the relationship between second layer region's Eu and light-receiving member exposure memory (light memory) at different Eg values in the second layer region of the photoconductive layer, with regard to the light-receiving member of the present invention.

Performances of the various light-receiving members thus produced were evaluated to obtain the results as respectively shown in FIGS. 7, 8 and 9. These FIGS. 7, 8 and 9 show the relationship between second layer region's Eu and light-receiving member's charging performance, temperature properties and exposure memory, respectively, at different Eg values in the second layer region of the photoconductive layer, with regard to the light-receiving member of the present invention. Charging performance, temperature properties and memory potential are indicated in terms of relative values, assuming as 1 the values of the light-receiving member having a photoconductive layer formed of only the first layer region. As is clear from these results, light-receiving members having second layer regions especially with an Eg of 1.8 eV or above and an Eu of 55 meV or below show improved performances in respect of all the charging performance, temperature properties and exposure memory.

EXAMPLE 2

An electrophotographic light-receiving member according to the present invention was produced in the same manner as in Example 1 (under conditions as shown in Table 1) except that the first layer region and the second layer region were superposingly formed in reverse order.

Performances of the light-receiving member thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially in respect of charging performance, temperature dependence and coarse images, the present light-receiving member showed better performances than a light-receiving member having a photoconductive layer formed of only the first layer region.

In the present Example also, various light-receiving members having different Ch, Eg and Eu in the second layer region were produced in the same manner as in Example 1. In the present Example, light-receiving members having second layer regions especially with an Eg of 1.8 eV or above and an Eu of 55 meV or below showed improved performances in respect of charging performance and temperature properties, and caused much less coarse images.

EXAMPLE 3

An electrophotographic light-receiving member according to the present invention was produced in the same manner as in Example 1 (under conditions as shown in Table 1) except that the photoconductive layer was constituted of a second layer region, a first layer region and another second layer region, superposingly formed in this order from the charge injection blocking layer side.

Performances of the light-receiving member thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially, in the present Example, in respect of all the charging performance, temperature dependence, exposure memory and coarse images, the present light-receiving member showed better performances than a light-receiving member having a photoconductive layer formed of only the first layer region.

In the present Example also, various light-receiving members having different Ch, Eg and Eu in the second layer region were produced in the same manner as in Example 1. In the present Example, light-receiving members having second layer regions especially with an Eg of 1.8 eV or above and an Eu of 55 meV or below showed improved performances in respect of all the charging performance, temperature properties, exposure memory and coarse images.

EXAMPLE 4

An electrophotographic light-receiving member according to the present invention was produced in the same manner as in Example 1 but under conditions as shown in Table 2.

The first layer region of the photoconductive layer had a hydrogen content (Ch) of 20 atomic %, an optical bandgap (Eg) of 1.77 eV and a characteristic energy (Eu) of 60 meV. The second layer region had a Ch of 31 atomic %, an Eg of 1.83 eV and an Eu of 52 meV. These results are values obtained by the method described later as "Measurement of Ch, Eg and Eu".

Performances of the light-receiving member thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially in respect of charging performance, temperature dependence and exposure memory, the present light-receiving member showed better performances than a light-receiving member having a photoconductive layer formed of only the first layer region.

TABLE 2

| Gas species/ Conditions | Charge injection blocking layer | Photoconductive layer First layer region | Second layer region | Surface layer |
|---|---|---|---|---|
| $SiH_4$ (SCCM) | 150 | 150 | 100 | 10 |
| $H_2$ (SCCM) | 300 | 800 | 1,000 | 0 |
| $B_2H_6$ (ppm) (based on $SiH_4$) | 2,000 | 2 | 0.5 | 0 |
| NO (SCCM) | 5 | 0 | 0 | 0 |
| $CH_4$ (SCCM) | 0 | 0 | 0 | 500 |
| Support temp. (°C.) | 260 | 260 | 260 | 260 |
| Pressure (Torr) | 0.4 | 0.5 | 0.5 | 0.3 |
| RF power (W) | 300 | 600 | 600 | 200 |
| Layer thickness (μm) | 3 | 25 | 2 | 0.5 |

EXAMPLE 5

An electrophotographic light-receiving member according to the present invention was produced in the same manner as in Example 1 except that, under conditions as shown in Table 3, the photoconductive layer was constituted of a second layer region and a first layer region, superposingly formed in this order from the charge injection blocking layer side, and the density distribution of silicon atoms and carbon atoms in the surface layer was made gradient in its thickness direction.

In Table 3, numerical values for the surface layer are shown with arrows (→), which indicate changes in gas flow rate. This applies those in the subsequent tables. In Table 3, the data indicate that the flow rates of $SiH_4$ and $CH_4$ were changed (i.e., $SiH_4$ was decreased and $CH_4$ was increased) to form regions in which the compositional ratios of Si atoms and that of C atoms were gradually changed and thereafter the flow rates of $SiH_4$ and $CH_4$ were kept constant to form regions in which the compositional ratios of these were uniform.

Performances of the light-receiving member thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially in respect of charging performance, temperature dependence and coarse images, the present light-receiving member showed better performances than a light-receiving member having a photoconductive layer formed of only the first layer region.

TABLE 3

| Gas species/ Conditions | Charge injection blocking layer | Photoconductive layer Second layer region | First layer region | Surface layer |
|---|---|---|---|---|
| $SiH_4$ (SCCM) | 150 | 100 | 200 | 200→20→20 |
| $H_2$ (SCCM) | 300 | 800 | 1,000 | 0 |

TABLE 3-continued

| Gas species/ Conditions | Charge injection blocking layer | Photoconductive layer Second layer region | First layer region | Surface layer |
|---|---|---|---|---|
| $B_2H_6$ (ppm) (based on $SiH_4$) | 2,000 | 0.5 | 2 | 0 |
| NO (SCCM) | 5 | 0 | 0 | 0 |
| $CH_4$ (SCCM) | 0 | 0 | 0 | 50→600→600 |
| Support temp. (°C.) | 280 | 280 | 280 | 280 |
| Pressure (Torr) | 0.4 | 0.5 | 0.5 | 0.5 |
| RF power (W) | 300 | 600 | 600 | 150 |
| Layer thickness (μm) | 3 | 5 | 25 | 0.5 |

(Note)→: Flow rates were changed in the order indicated by arrows (→).

EXAMPLE 6

An electrophotographic light-receiving member according to the present invention was produced in the same manner as in Example 1 except that, under conditions as shown in Table 4, the photoconductive layer was constituted of a second layer region and a first layer region, superposingly formed in this order from the charge injection blocking layer side, the density distribution of silicon atoms and carbon atoms in the surface layer was made gradient in its thickness direction, and fluorine atoms, boron atoms, carbon atoms, oxygen atoms and nitrogen atoms were incorporated in all the layers.

Performances of the light-receiving member thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially in respect of charging performance, temperature dependence and coarse images, the present light-receiving member showed better performances than a light-receiving member having a photoconductive layer formed of only the first layer region.

TABLE 4

| Gas species/ Conditions | Charge injection blocking layer | Photoconductive layer Second layer region | First layer region | Surface layer |
|---|---|---|---|---|
| $SiH_4$ (SCCM) | 150 | 50 | 150 | 200→10→10 |
| $SiF_4$ (SCCM) | 5 | 1 | 1 | 5 |
| $H_2$ (SCCM) | 500 | 400 | 600 | 0 |
| $B_2H_6$ (ppm) (based on $SiH_4$) | 1,500 | 1 | 2 | 1 |
| NO (SCCM) | 10 | 0.1 | 0.1 | 0.5 |
| $CH_4$ (SCCM) | 5 | 0.2 | 0.2 | 50→600→700 |
| Support temp. (°C.) | 270 | 260 | 260 | 250 |
| Pressure (Torr) | 0.3 | 0.4 | 0.4 | 0.4 |

TABLE 4-continued

| Gas species/ Conditions | Charge injection blocking layer | Photoconductive layer: Second layer region | Photoconductive layer: First layer region | Surface layer |
|---|---|---|---|---|
| RF power (W) | 200 | 400 | 600 | 100 |
| Layer thickness (μm) | 3 | 2 | 20 | 0.5 |

(Note)→: Flow rates were changed in the order indicated by arrows (→).

EXAMPLE 7

An electrophotographic light-receiving member according to the present invention was produced in the same manner as in Example 1 except that, under conditions as shown in Table 5, the density distribution of silicon atoms and carbon atoms in the surface layer was made gradient in its thickness direction, and an IR absorption layer was provided between the support and the charge injection blocking layer. This IR absorption layer was provided in order to prevent interference patterns from occurring due to light reflected from the support.

Performances of the light-receiving member thus produced were evaluated in the manner as described later. As a result, good values were obtained on all the charging performance, temperature properties and exposure memory. No exposure memory was seen also with regard to images. Neither spots nor smeared images also occurred, no interference patterns occur and coarse images were only a little seen, showing good image characteristics. Especially in respect of charging performance, temperature dependence and exposure memory, the present light-receiving member showed better performances than a light-receiving member having a photoconductive layer formed of only the first layer region.

TABLE 5

| Gas species/ Conditions | IR absorption layer | Charge injection blocking layer | Photoconductive layer: First layer region | Photoconductive layer: Second layer region | Surface layer |
|---|---|---|---|---|---|
| $SiH_4$ (SCCM) | 150 | 150 | 150 | 75 | 150→15→10 |
| $GeH_4$ (SCCM) | 50 | 0 | 0 | 0 | 0 |
| $H_2$ (SCCM) | 200 | 200 | 800 | 800 | 0 |
| $B_2H_6$ (ppm) (based on $SiH_4$) | 3,000 | 2,000 | 0.5 | 0.1 | 0 |
| NO (SCCM) | 15→10 | 10→0 | 0 | 0 | 0 |
| $CH_4$ (SCCM) | 0 | 0 | 0 | 0 | 0→500→600 |
| Support temp. (°C.) | 260 | 260 | 260 | 260 | 260 |
| Pressure (Torr) | 0.4 | 0.4 | 0.4 | 0.4 | 0.4 |
| RF power (W) | 150 | 150 | 600 | 500 | 200 |
| Layer thickness (μm) | 1 | 3 | 25 | 5 | 0.7 |

(Note)→: Flow rates were changed in the order indicated by arrows (→).

EXAMPLE 8

An electrophotographic light-receiving member according to the present invention was produced in the same manner as in Example 1 except that, under conditions as shown in Table 6, the photoconductive layer was constituted of a second layer region, a first layer region and another second layer region, superposingly formed in this order from the charge injection blocking layer side, and the density distribution of silicon atoms and carbon atoms in the surface layer was made gradient in its thickness direction.

Performances of the light-receiving member thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially, in the present Example, in respect of all the charging performance, temperature dependence, exposure memory and coarse images, the present light-receiving member showed better performances than a light-receiving member having a photoconductive layer formed of only the first layer region.

TABLE 6

| Gas species/ Conditions | Charge injection blocking layer | Photoconductive layer: Second layer region | Photoconductive layer: First layer region | Photoconductive layer: Second layer region | Surface layer |
|---|---|---|---|---|---|
| $SiH_4$ (SCCM) | 100 | 100 | 100 | 100 | 200→10 |
| $H_2$ (SCCM) | 300 | 800 | 400 | 800 | 0 |
| $B_2H_6$ (ppm) (based on $SiH_4$) | 1,500 | 0.5 | 1 | 0.5 | 0 |
| NO (SCCM) | 10 | 0 | 0 | 0 | 0 |
| $CH_4$ (SCCM) | 0 | 0 | 0 | 0 | 10→600 |
| Support temp. (°C.) | 300 | 280 | 300 | 280 | 300 |
| Pressure (Torr) | 0.4 | 0.5 | 0.5 | 0.5. | 0.4 |
| RF power (W) | 200 | 600 | 400 | 600 | 150 |
| Layer thickness (μm) | 3 | 2 | 25 | 2 | 0.5 |

(Note)→: Flow rates were changed in the order indicated by arrows (→)

EXAMPLE 9

Electrophotographic light-receiving members according to the present invention were produced in the same manner as in Example 1 except that, under conditions as shown in Table 7, films were formed by VHF-PCVD using the production apparatus shown in FIG. 6, the photoconductive layers were each constituted of a second layer region and a first layer region, superposingly formed in this order from the charge injection blocking layer side, and the density distribution of silicon atoms and carbon atoms in each surface layer was made gradient in its thickness direction.

The Ch, Eg and Eu of the first layer region were 23 atomic %, 1.76 eV and 62 meV, respectively. The Ch, Eg and Eu of the second layer region were 35 atomic %, 1.85 eV and 55 meV, respectively.

Performances of the light-receiving members thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially in respect of charging performance, temperature dependence and coarse images, the present light-receiving members showed better performances than light-receiving members having a photoconductive layer formed of only the first layer region.

TABLE 7

| Gas species/ Conditions | Charge injection blocking layer | Photoconductive layer Second layer region | Photoconductive layer First layer region | Surface layer |
|---|---|---|---|---|
| $SiH_4$ (SCCM) | 300 | 300 | 500 | 200→10→10 |
| $SiF_4$ (SCCM) | 5 | 3 | 3 | 10 |
| $H_2$ (SCCM) | 400 | 2,500 | 3,000 | 0 |
| $B_2H_6$ (ppm) (based on $SiH_4$) | 1,500 | 1 | 3 | 0 |
| NO (SCCM) | 10 | 0 | 0 | 0 |
| $CH_4$ (SCCM) | 0 | 0 | 0 | 0→500→500 |
| Support temp. (°C.) | 300 | 300 | 300 | 300 |
| Pressure (Torr) | 20 | 20 | 20 | 20 |
| VHF power (W) | 500 | 2,000 | 1,500 | 300 |
| Layer thickness (μm) | 3 | 3 | 25 | 0.5 |

(Note)→: Flow rates were changed in the order indicated by arrows (→)

EXAMPLE 10

Electrophotographic light-receiving members according to the present invention were produced in the same manner as in Example 1 except that, under conditions as shown in Table 8, films were formed by VHF-PCVD using the production apparatus shown in FIG. 6, and, in place of carbon atoms, nitrogen atoms were incorporated in the surface layers.

Performances of the light-receiving members thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially in respect of charging performance, temperature dependence and exposure memory, the present light-receiving members showed better performances than light-receiving members having a photoconductive layer formed of only the first layer region.

TABLE 8

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 300 | 100 | 20 |
| $H_2$ (SCCM) | 300 | 1,000 | 1,000 | 0 |
| $B_2H_6$ (ppm) (based on $SiH_4$) | 3,000 | 1 | 0.2 | 0 |
| NO (SCCM) | 5 | 0 | 0 | 0 |
| $NH_3$ (SCCM) | 0 | 0 | 0 | 200 |
| Support temp. (°C.) | 250 | 250 | 250 | 250 |
| Pressure (Torr) | 20 | 15 | 15 | 20 |

TABLE 8-continued

| Gas species/ Conditions | Charge injection blocking layer | Photoconductive layer First layer region | Photoconductive layer Second layer region | Surface layer |
|---|---|---|---|---|
| VHF power (W) | 300 | 1,000 | 800 | 300 |
| Layer thickness (μm) | 3 | 25 | 2 | 0.3 |

EXAMPLE 11

Electrophotographic light-receiving members according to the present invention were produced in the same manner as in Example 1 except that, under conditions as shown in Table 9, films were formed by VHF-PCVD using the production apparatus shown in FIG. 6, the photoconductive layers were each constituted of a second layer region and a first layer region, superposingly formed in this order from the charge injection blocking layer side, and, in addition to carbon atoms, nitrogen atoms and oxygen atoms were incorporated in the surface layers.

Performances of the light-receiving members thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially in respect of charging performance, temperature dependence and coarse images, the present light-receiving members showed better performances than light-receiving members having a photoconductive layer formed of only the first layer region.

TABLE 9

| Gas species/ Conditions | Charge injection blocking layer | Photoconductive layer Second layer region | Photoconductive layer First layer region | Surface layer |
|---|---|---|---|---|
| $SiH_4$ (SCCM) | 150 | 80 | 150 | 20 |
| $H_2$ (SCCM) | 400 | 800 | 800 | 0 |
| $B_2H_6$ (ppm) (based on $SiH_4$) | 1,500 | 1 | 2 | 0 |
| NO (SCCM) | 5 | 0 | 0 | 10 |
| $CH_4$ (SCCM) | 0 | 0 | 0 | 500 |
| Support temp. (°C.) | 290 | 290 | 290 | 290 |
| Pressure (Torr) | 10 | 10 | 10 | 10 |
| VHF power (W) | 500 | 600 | 600 | 200 |
| Layer thickness (μm) | 2 | 5 | 30 | 0.5 |

EXAMPLE 12

Electrophotographic light-receiving members according to the present invention were produced in the same manner as in Example 1 except that, under conditions as shown in Table 10, films were formed by VHF-PCVD using the production apparatus shown in FIG. 6, and an intermediate layer (upper blocking layer) containing less carbon atoms than the surface layer and also containing atoms capable of controlling its conductivity was provided between the photoconductive layer and the surface layer.

Performances of the light-receiving members thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially in respect of charging performance, temperature dependence and exposure memory, the present light-receiving members showed better performances than light-receiving members having a photoconductive layer formed of only the first layer region.

TABLE 10

| Gas species/ Conditions | Charge injection blocking layer | Photoconductive layer First layer region | Second layer region | Intermediate layer | Surface layer |
|---|---|---|---|---|---|
| $SiH_4$ (SCCM) | 150 | 200 | 100 | 100 | 10 |
| $H_2$ (SCCM) | 300 | 800 | 300 | 0 | 0 |
| $PH_3$ (ppm) (based on $SiH_4$) | 1,000 | 0 | 0 | 0 | 0 |
| $B_2H_6$ (ppm) (based on $SiH_4$) | 0 | 0.5 | 0.1 | 500 | 0 |
| $CH_4$ (SCCM) | 50 | 0 | 0 | 300 | 500 |
| Support temp. (°C.) | 270 | 260 | 260 | 250 | 250 |
| Pressure (Torr) | 20 | 30 | 30 | 15 | 15 |
| VHF power (W) | 200 | 800 | 800 | 300 | 200 |
| Layer thickness (μm) | 3 | 20 | 5 | 0.1 | 0.5 |

EXAMPLE 13

Electrophotographic light-receiving members according to the present invention were produced in the same manner as in Example 1 except that, under conditions as shown in Table 11, films were formed by VHF-PCVD using the production apparatus shown in FIG. 6, $CH_4$ gas was replaced with $C_2H_2$ gas as the carbon source, the charge injection blocking layer was not provided, the photoconductive layers were each constituted of a second layer region, a first layer region and another second layer region, superposingly formed in this order from the support side, and the density distribution of silicon atoms and carbon atoms in each surface layer was made gradient in its thickness direction.

Performances of the light-receiving members thus produced were evaluated in the manner as described later. As a result, good values were obtained on all the charging performance, temperature properties and exposure memory. No exposure memory was seen also with regard to images. Neither spots nor smeared images also occurred, and coarse images were only a little seen, showing good image characteristics. Especially, in the present Example, in respect of all the charging performance, temperature dependence, exposure memory and coarse images, the present light-receiving members showed better performances than light-receiving members having a photoconductive layer formed of only the first layer region.

TABLE 11

| Gas species/ Conditions | Photoconductive layer Second layer region | First layer region | Second layer region | Surface layer |
|---|---|---|---|---|
| $SiH_4$ (SCCM) | 100 | 100 | 100 | 200→50→20 |
| $H_2$ (SCCM) | 1,000 | 400 | 1,000 | 0 |
| $B_2H_6$ (ppm) (based on $SiH_4$) | 3 | 5 | 2 | 0 |
| $C_2H_2$ (SCCM) | 10 | 10 | 10 | 20→200→300 |
| Support temp. (°C.) | 280 | 280 | 280 | 270 |
| Pressure (Torr) | 50 | 50 | 50 | 20 |
| VHF power (W) | 800 | 400 | 800 | 300 |
| Layer thickness (μm) | 5 | 20 | 5 | 0.5 |

(Note)→: Flow rates were changed in the order indicated by arrows (→)

Measurement of Ch, Eg, Eu

First, in the production apparatus, the aluminum cylinder (support) set therein was replaced with a sample holder. This sample holder is used to place sample substrates on it. It has been worked to have grooves, and has a cylindrical shape.

To measure Ch, the following procedure was taken. Using silicon wafers as the sample substrates (supports), the wafers were placed on the sample holder of the production apparatus, and the first layer region and the second layer region were respectively sepaprately formed on the surfaces of the substrates under predetermined conditions. The layers were each formed in a thickness of about 1 μm. The substrate having the first layer region and the substrate having the second layer region thus obtained were each spectrally measured by FTIR (Fourier transformation infrared absorption spectroscopy) to determine the Ch.

To measure Eg and Eu, the following procedure was taken. Using glass substrates (#7059; available from Corning Glass Works) as the sample substrates, the substrates were placed on the sample holder of the production apparatus, and the first layer region and the second layer region were respectively sepaprately formed on the surfaces of the substrates under predetermined conditions. The layers were each formed in a thickness of about 1 μm. The substrate having the first layer region and the substrate having the second layer region thus obtained were first put to the measurement of Eg. Subsequently, Cr comb electrodes were formed on these substrates by vacuum deposition, and thereafter the substrates were put to measurement of subbandgap light absorption spectra by CPM to determine the Eu.

Measurement of Optical Bandgap (Eg)

Transmittance at each wavelength of amorphous silicon films deposited on glass substrates was measured using a spectrophotometer, and absorptivity coefficient (α) is calculated according to the following Expression (III).

$$\alpha=(-1/d)\times\ln(T) \quad \text{(III)}$$

where d is layer thickness (cm), and T is transmittance.

Next, the photon energy, hν (eV), of each wavelength is plotted as abscissa, and the square root of the product of absorptivity coefficient (α) and photon energy, $(\alpha\times h\nu)^{1/2}$, is plotted as ordinate. A value of point at which an extension of the straight line portion of the plotted curve crosses the ordinate represents the Eg.

Performance Evaluation

The light-receiving members produced were each set in and electrophotographic apparatus (a copying machine NP-6550, manufactured by CANON INC., modified for testing), and images were reproduced to make evaluation. Here, the process speed was set at 380 mm/sec; pre-exposure (LED with a wavelength of 565 nm), at 4 lux.sec; and electric current of its charging assembly, at 100 μA.

Charging performance

A surface potentiometer (Model 344, manufactured by Trek Co.) was set at the position of the developing assembly of the electrophotographic apparatus, and the surface potential of the light-receiving member was measured with it under the above conditions. The value thus obtained was used to represent charging performance.

Temperature properties (temperature dependence)

Temperature of the light-receiving member was changed from room temperature (about 25° C.) to 50° C. by means of a built-in drum heater, and the charging performance was measured under the above conditions. The amount of changes in charging performance per temperature 1° C. during the measurement was used to represent the temperature properties (temperature dependence).

Memory potential

Using a halogen lamp as an exposure light source, the charging performance (surface potential) was measured under the above conditions at each time when not exposed and when again exposed and charged after once exposed and charged, and the difference between the both was used to represent the memory potential.

Image characteristics

The light-receiving members produced were each set in an electrophotographic apparatus, and images were formed to visually judge exposure memory, coarse images, spots and smeared images.

The charging performance, temperature properties and memory potential shown in FIGS. 7, 8 and 9, respectively, are shown as relative values, assuming as 1 the value of a light-receiving member having a photoconductive layer formed of only the first layer region. Here, the light-receiving member having a photoconductive layer formed of only the first layer region was produced under the same conditions for the production of the corresponding light-receiving member having the first layer region and the second layer region.

As is clear from what has been described above, according to the present invention, the hydrogen atom and/or halogen atom content (Ch), optical bandgaps (Eg) and characteristic energy (Eu) are controlled and also two kinds of layers having difference values for these are superposingly formed, and hence the light-receiving member can be greatly improved in its photoconductive and photoelectric-conversionary properties. For example, the charging performance can be greatly improved, and at the same time its temperature dependence can be made lower, the exposure memory such as blank memory and ghost can be made substantially free from occurring, and the uniformity of image density can be improved (i.e., what is called coarse images can be made less occur).

Moreover, in the case when the photoconductive layer is constituted of the first layer region and the second layer region, superposingly formed in this order from the support side, the light-receiving member shows better performances in respect of charging performance, temperature dependence and exposure memory, than the light-receiving member having a photoconductive layer formed of only the first layer region. In the case when the photoconductive layer is constituted of the second layer region and the first layer region, superposingly formed in this order from the support side, the light-receiving member shows better performances in respect of charging performance, temperature dependence and coarse images, than the light-receiving member having a photoconductive layer formed of only the first layer region. In the case when the photoconductive layer is constituted of the second layer region, the first layer region and the another second layer region, superposingly formed in this order from the support side, the light-receiving member shows better performances in respect of all the charging performance, temperature dependence, exposure memory and coarse images, than the light-receiving member having a photoconductive layer formed of only the first layer region.

The electrophotographic apparatus having the light-receiving member of the present invention enable formation of high-quality images free of spots or smeared images, sharp in halftone and having a high resolution.

The above various performances can be more improved when the light-receiving member is provided with the charge injection blocking layer, the surface layer, the light absorption layer (e.g., the IR absorption layer), the intermediate layer (the upper blocking layer), the blocking layer (the lower surface layer) and the adherent layer.

What is claimed is:

1. A light-receiving member for electrophotography comprising:

a support and a photoconductive layer;

wherein the photoconductive layer comprises a non-single-crystal material comprising silicon atoms as a matrix and containing at least one of hydrogen atoms and halogen atoms;

and wherein the photoconductive layer comprises:

a first layer region formed by a layer having an optical bandgap (Eg) of 1.70 eV to 1.82 eV and a characteristic energy (Eu) of 50 meV to 65 meV, wherein Eu is obtained from the linear relationship portion or exponential tail of a function represented by Expression (I):

$$\ln \alpha = (1/Eu) \cdot h\nu + \alpha_1 \quad \text{(I)}$$

where photon energy hν is set as an independent variable and absorptivity coefficient α of light absorption spectrum as a dependent variable, and at least one second layer region formed by a layer having Eg of 1.78 eV to 1.85 eV and Eu of 50 meV to 60 meV, wherein the Eg of the first layer region is smaller than the Eg of the second layer region and the Eu of the first layer region is larger than the Eu of the second layer region.

2. The light-receiving member according to claim 1, wherein said at least one of hydrogen atoms and halogen atoms is contained in a hydrogen atom or halogen atom content (Ch) of from 10 atomic % to 30 atomic % in the first layer region and from 20 atomic % to 40 atomic % in the second layer region, provided that the Ch in the first layer region is smaller than the Ch of the second layer region.

3. The light-receiving member according to claim 1, wherein the photoconductive layer and one second layer region of the photoconductive layer have a thickness ratio of 1:0.003 to 1:0.15.

4. The light-receiving member according to claim 1, wherein said photoconductive layer has one first layer region and one second layer region each, and the second layer region is superposingly formed on the first layer region.

5. The light-receiving member according to claim 1, wherein said photoconductive layer has one first layer region and one second layer region each, and the first layer region is superposingly formed on the second layer region.

6. The light-receiving member according to claim 1, wherein said photoconductive layer has one first layer region and two second layer regions, and the first layer region is superposingly formed on one of the second layer regions and the other second layer region is superposingly formed on the first layer region.

7. The light-receiving member according to claim 1, wherein said photoconductive layer contains at least one kind of atoms belonging to Group 13 of the periodic table, capable of imparting p-type conductivity, and atoms belonging to Group 15 of the periodic table, capable of imparting n-type conductivity.

8. The light-receiving member according to claim 1, wherein said photoconductive layer contains at least one kind of atoms selected from the group consisting of carbon, oxygen and nitrogen atoms.

9. The light-receiving member according to claim 1, wherein a surface layer comprising silicon atoms and containing at least one kind of atoms selected from the group consisting of carbon, oxygen and nitrogen atoms is superposingly formed on said photoconductive layer.

10. The light-receiving member according to claim 9, wherein said surface layer has a thickness of from 0.01 μm to 3 μm.

11. The light-receiving member according to claim 1, wherein said photoconductive layer is provided on a charge injection blocking layer formed of a non-single-crystal material mainly composed of silicon atoms and containing at least one kind of atoms selected from the group consisting of carbon, oxygen and nitrogen atoms and at least one kind of atoms belonging to Group 13 of the periodic table capable of imparting p-type conductivity and atoms belonging to Group 15 of the periodic table capable of imparting n-type conductivity.

12. The light-receiving member according to claim 11, wherein said charge injection blocking layer has a thickness of from 0.1 μm to 5 μm.

13. The light-receiving member according to claim 1, wherein said photoconductive layer has a thickness of from 20 μm to 50 μm.

14. The light-receiving member according to claim 9, wherein said photoconductive layer is provided on a charge injection blocking layer formed of a non-single-crystal material mainly composed of silicon atoms and containing at least one kind of atoms selected from the group consisting of carbon, oxygen and nitrogen atoms and at least one of atoms belonging to Group 13 of the periodic table capable of imparting p-type conductivity and atoms belonging to Group 15 of the periodic table capable of imparting n-type conductivity.

15. The light-receiving member according to claim 11, wherein said charge injection blocking layer has a thickness of from 0.1 μm to 5 μm.

16. The light-receiving member according to claim 9, wherein said non-single-crystal material is amorphous.

17. The light-receiving member according to claim 11, wherein said non-single-crystal material is amorphous.

18. The light-receiving member according to claim 14, wherein said non-single-crystal material is amorphous.

19. The light-receiving member according to claim 1, wherein a surface layer is provided on said photoconductive layer.

20. The light-receiving member according to claim 1, wherein a charge injection blocking layer is provided between said photoconductive layer and said support.

21. The light-receiving member according to claim 20, wherein said charge injection blocking layer has atoms belonging to Group 13 or Group 15 of the periodic table.

22. The light-receiving member according to claim 1, wherein a charge injection blocking layer is provided between said photoconductive layer and said support, and a surface layer is provided on said photoconductive layer.

23. The light-receiving member according to claim 22, wherein said charge injection blocking layer has atoms belonging to Group 13 or Group 15 of the periodic table.

24. The light-receiving member according to claim 1, wherein said non-single-crystal material is amorphous.

* * * * *